US011391077B2

(12) United States Patent
Zimmer et al.

(10) Patent No.: US 11,391,077 B2
(45) Date of Patent: Jul. 19, 2022

(54) HINGE WITH MULTI-STAGE OPENING ACTION

(71) Applicants: Martin Zimmer, Rheinau (DE); Günther Zimmer, Rheinau (DE)

(72) Inventors: Martin Zimmer, Rheinau (DE); Günther Zimmer, Rheinau (DE)

( * ) Notice: Subject to any disclaimer, the term of this patent is extended or adjusted under 35 U.S.C. 154(b) by 82 days.

(21) Appl. No.: 17/055,385

(22) PCT Filed: May 15, 2019

(86) PCT No.: PCT/DE2019/000138
§ 371 (c)(1),
(2) Date: Apr. 12, 2021

(87) PCT Pub. No.: WO2019/219107
PCT Pub. Date: Nov. 21, 2019

(65) Prior Publication Data

US 2021/0404233 A1 Dec. 30, 2021

(30) Foreign Application Priority Data

May 16, 2018 (DE) ..... 10 2018 003 920.0

(51) Int. Cl.
*E05D 11/10* (2006.01)
*E05F 1/10* (2006.01)
*E05D 11/08* (2006.01)

(52) U.S. Cl.
CPC ..... *E05F 1/1033* (2013.01); *E05D 11/087* (2013.01); *E05Y 2201/454* (2013.01);
(Continued)

(58) Field of Classification Search
CPC ..... Y10T 16/5387; Y10T 16/5403; Y10T 16/54035; Y10T 16/540255; G06F 1/1681;
(Continued)

(56) References Cited

U.S. PATENT DOCUMENTS 5,855,040 A 1/1999 Lin
7,168,134 B2 * 1/2007 Minami ..... G06F 1/1681 16/303
(Continued)

FOREIGN PATENT DOCUMENTS

DE 102009035682 A1 2/2011
DE 102011007401 A1 10/2012

*Primary Examiner* — Chuck Y Mah
(74) *Attorney, Agent, or Firm* — Smartpat PLC

(57) ABSTRACT

A hinge has two arms that can be pivoted relative to one another between a closed initial position and a second position. A first arm has a first guide slide. A second guide slide can be shifted along the pivot axis and can contact the first guide slide. When the two arms are moved towards the initial position, at least one cylinder-piston unit can be loaded by means of the second guide slide. The second guide slide can be rotationally fixedly coupled to the second arm in a first pivoting angle sub-range bordering the initial position and to the first arm in a second pivoting angle sub-range bordering the second position. The hinge has a first control slide rigidly connected to the second arm and a second control slide that makes contact with the first control slide and that is coupled against rotation to the first guide slide.

12 Claims, 10 Drawing Sheets

(52) U.S. Cl.
CPC ... *E05Y 2201/456* (2013.01); *E05Y 2201/638* (2013.01); *E05Y 2900/20* (2013.01)

(58) Field of Classification Search
CPC .... G06F 1/1616; G06F 1/1618; G06F 1/1679; H05K 5/0226; H04M 1/0216; E05Y 2900/606; E05Y 2201/422; E05Y 2201/638; E05Y 2201/454; E05Y 2201/456; E05Y 2900/20; E05D 11/1042; E05D 11/087; E05D 11/08; E05D 11/082; E05D 11/084; E05D 11/085; E05D 3/02; F16C 11/00; F16C 11/12; E05F 1/1033
See application file for complete search history.

(56) References Cited

U.S. PATENT DOCUMENTS 8,898,860 B2 * 12/2014 Bacchetti ..... E05D 3/02 16/303
9,206,636 B2 * 12/2015 Nagl ..... E05F 1/1215
9,926,732 B2 * 3/2018 Bacchetti ..... E05F 3/12
2001/0004776 A1 * 6/2001 Fujita ..... A47K 13/12 4/236
2003/0177605 A1 * 9/2003 Wang ..... E05F 1/1223 16/50
2005/0225093 A1 * 10/2005 Zuo ..... H04M 1/0216 292/1
2006/0032020 A1 * 2/2006 Duan ..... G06F 1/1616 16/288
2006/0242796 A1 11/2006 Duan et al.
2006/0255045 A1 * 11/2006 Kim ..... E05F 1/1215 220/531
2007/0089273 A1 * 4/2007 Kang ..... E05F 3/20 16/330
2010/0319260 A1 * 12/2010 Sawa ..... E05F 1/1223 49/326
2011/0302743 A1 * 12/2011 Kim ..... E05F 1/1215 16/248
2014/0137478 A1 5/2014 Nagl et al.
2015/0345203 A1 * 12/2015 Vanini ..... E05F 3/14 16/68
2016/0017648 A1 1/2016 Petrelli
2020/0370348 A1 * 11/2020 Naganuma ..... E05D 3/02

* cited by examiner

HINGE WITH MULTI-STAGE OPENING ACTION

TECHNICAL FIELD

The disclosure relates to a hinge with two arms that can be pivoted relative to one another through a pivoting angle range between a closed initial position and a second position.

BACKGROUND

A hinge is generally known from DE 10 2009 035 682 A1. The pivoting angle of the hinge is bounded by an initial position and an end position.

SUMMARY

The present disclosure is based on the problem of developing a hinge with a multi-stage opening action. This problem is solved with the features as claimed.

The novel hinge has two arms that can be pivoted relative to one another through a pivoting angle range between a closed initial position (first position) and a second position. A first arm has a first guide slide. The hinge has a second guide slide that can be shifted along the pivot axis and that can contact the first guide slide. When the two arms are moved towards the initial position, at least one cylinder-piston unit can be loaded by means of the second guide slide. The second guide slide can be rotationally fixedly coupled to the second arm in a first pivoting angle sub-range bordering the initial position and to the first arm in a second pivoting angle sub-range bordering the second position. The hinge has a first control slide rigidly connected to the second arm and a second control slide that makes contact with the first control slide and that is coupled non-rotatably to the second guide slide.

The present disclosure provides a hinge, the arms of which can be opened relative to one another initially from the initial position to an operating end position. The closing of the hinge from the operating end position to the initial position is delayed at least by a linear damper. If, for example, the hinge is to be opened further than the operating end position in an emergency, the relative movement is displaced from the guide slides to the control slides. The hinge can then be opened further to the second position.

For example, in order to displace the relative movement, the first guide slide contacts a stop or ramp fixedly connected to the second guide slide upon the opening movement in an operating end position located between the initial position and the second position. However, relative movements of the guide slides relative to one another and of the control slides relative to one another can also take place simultaneously in an angle sub-range. Upon closing the hinge from the second position in the direction of the initial position, the return movements of the control slides and the guide slides can take place simultaneously, overlapping in some areas, or one after the other. For example, upon the closing movement, a stop can limit the relative movement of the control slides to one another, such that the pivoting movement of the arms relative to one another is displaced into the movement joint of the guide slides. The return movement can, for example, be supported at least in some areas by means of a torsion element arranged between the arms, wherein such torsion element delays the pivoting movement in an additional pivoting sub-range. The torsion element can be formed as an individual part or as a component group.

The control slides can have a plurality of contact zones engaged in succession, depending on the pivoting angle. Thus, a contact zone bordering the second position of the hinge can be formed in such a manner that an internal return force in the direction of the operating end position, which is reduced compared to a first contact zone bordering the operating end position, acts in it. However, this internal return force is designed in such a manner that, when it is returned to the initial position, initially the control slides and then the guide slides are pivoted back.

Further details of the invention arise from the following description of schematically illustrated exemplary embodiments.

DETAILED DESCRIPTION

Figure 1:
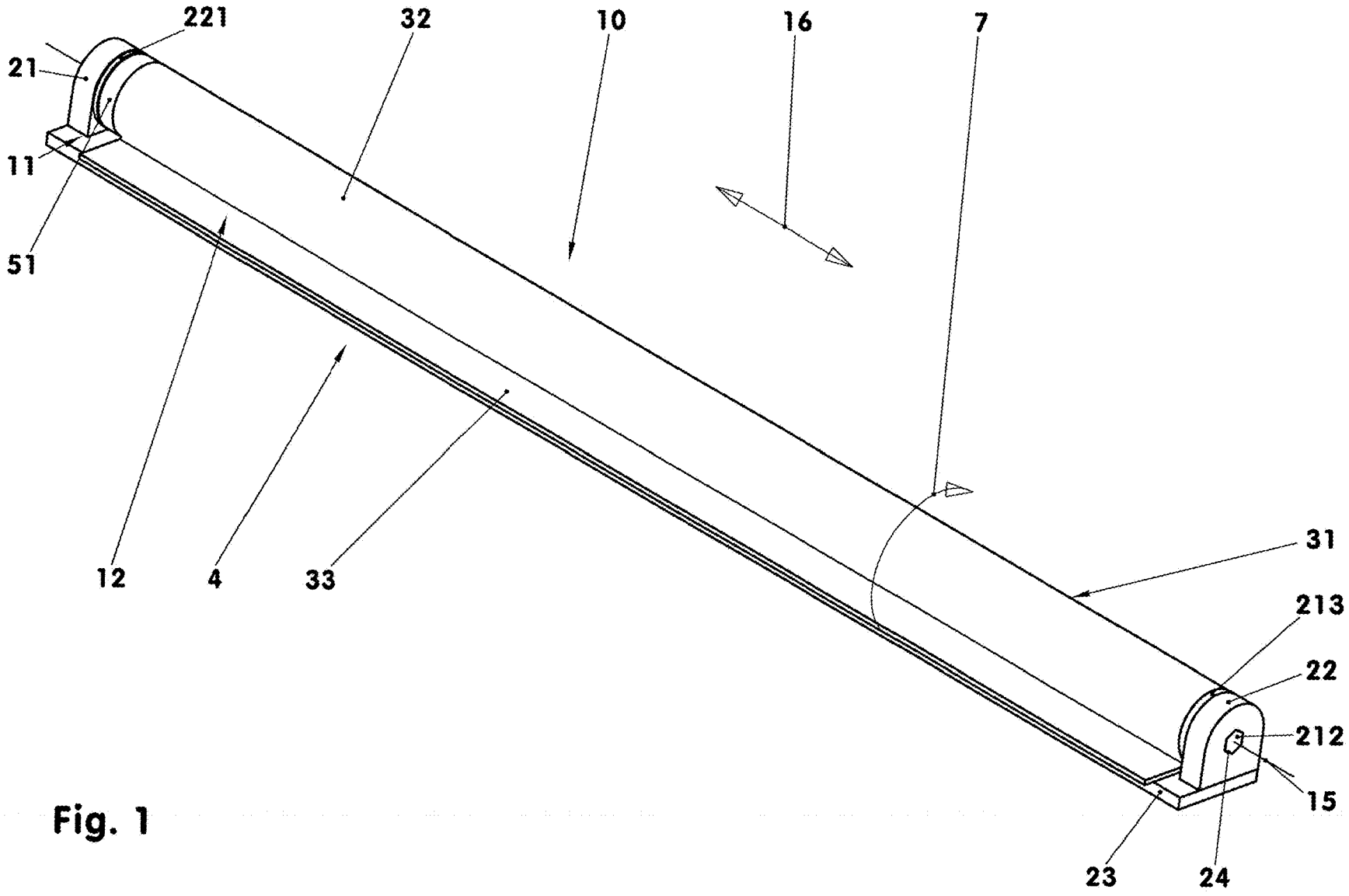
FIG. 1: Hinge.

FIGS. 1-29 show a hinge (10) of a piece of furniture. Such hinges are used to pivot a door or a lid relative to a furniture body. For this purpose, the hinge (10) has two hinge arms (11, 12) or arms (11, 12), a first hinge arm (11) of which is fastened to the furniture body and a second hinge arm (12) of which is fastened to the door or lid. However, it is also conceivable to fasten the first hinge arm (11) to the door or lid and the second hinge arm (12) to the furniture body. FIG. 1 shows the hinge (10) in the closed position. From this initial position (4), the two hinge arms (11, 12) can be pivoted relative to one another in the opening direction (7), for example by an angle of 95 degrees into an operating end position (5) and by 180 degrees into a second position (6). For example, the length of the hinge (10) in the longitudinal direction (16) oriented in the direction of the pivot axis (15) is 575 millimeters.

The first hinge arm (11) has two brackets (21, 22), which form the two ends of the hinge (10) in the longitudinal direction (16). The two brackets (21, 22), which are, for example, identical to one another, are connected to one another by means of a fastening plate (23) in the illustration of FIG. 1. Such fastening plate (23) can be fastened to the furniture body. However, it is also conceivable to fasten the two brackets (21, 22) directly to the furniture body.

The second hinge arm (12) comprises a hinge sleeve (31). This is made, for example, from a rolled plate. The hinge sleeve (31) has a cylindrically shaped receiving sleeve (32) with a connecting plate (33) formed thereon. In the illustration of FIG. 1, the connecting plate (33) is parallel to the fastening plate (23). For example, the length of the hinge sleeve (31) is 94% of the length of the hinge (10). In the exemplary embodiment, the outer diameter of the receiving sleeve (32) is 30 millimeters.

Between the hinge sleeve (31) and the bracket (22), a ring adapter (213) of a torsion element receptacle (211) is visible on the right side of the illustration of FIG. 1. On the left side of the illustration of FIG. 1, between the hinge sleeve (31) and the bracket (21), there is a receiving tube (51) and an intermediate ring (221).

Figure 2:
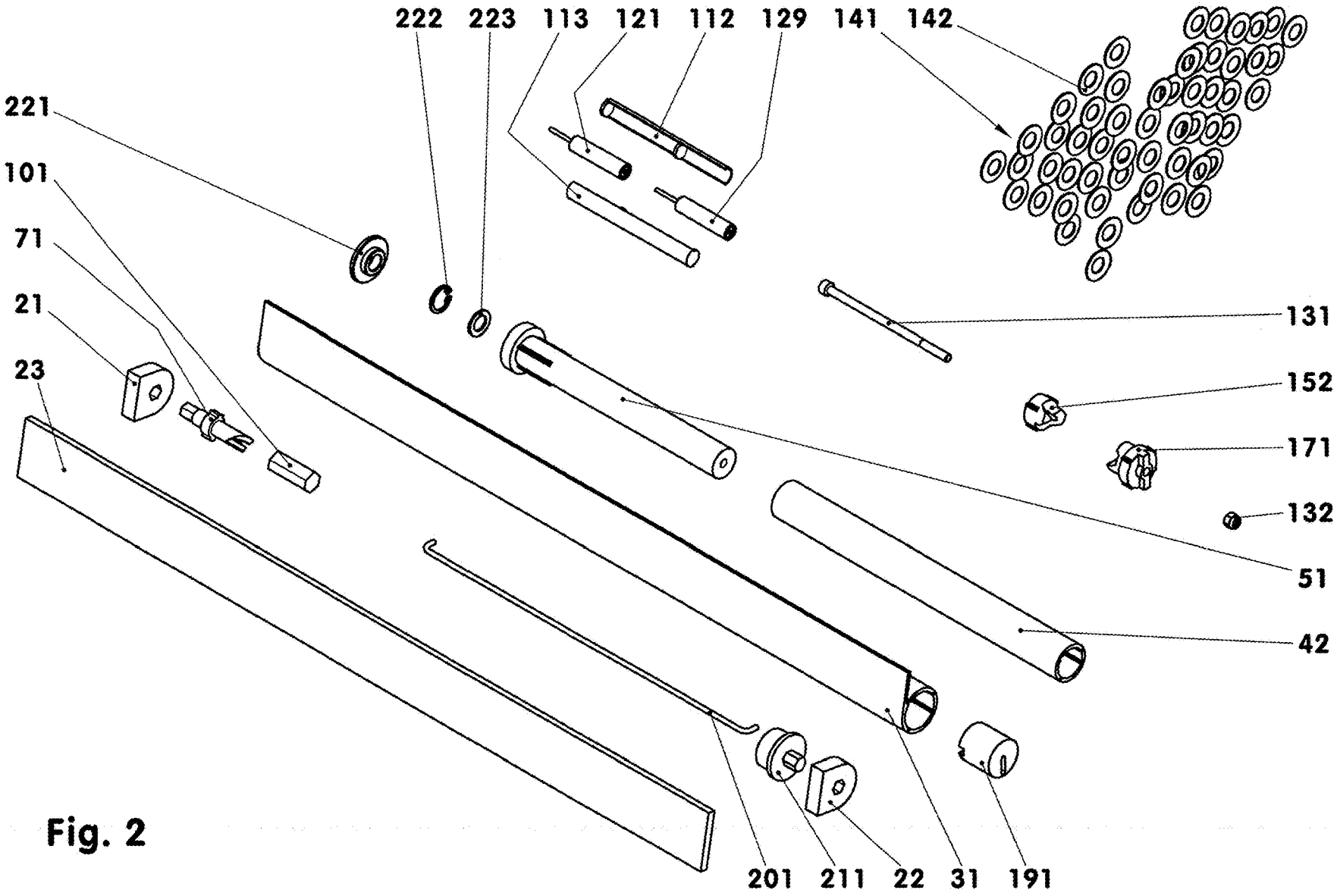
FIG. 2: Exploded view of the hinge shown in FIG. 1.
Figure 3:
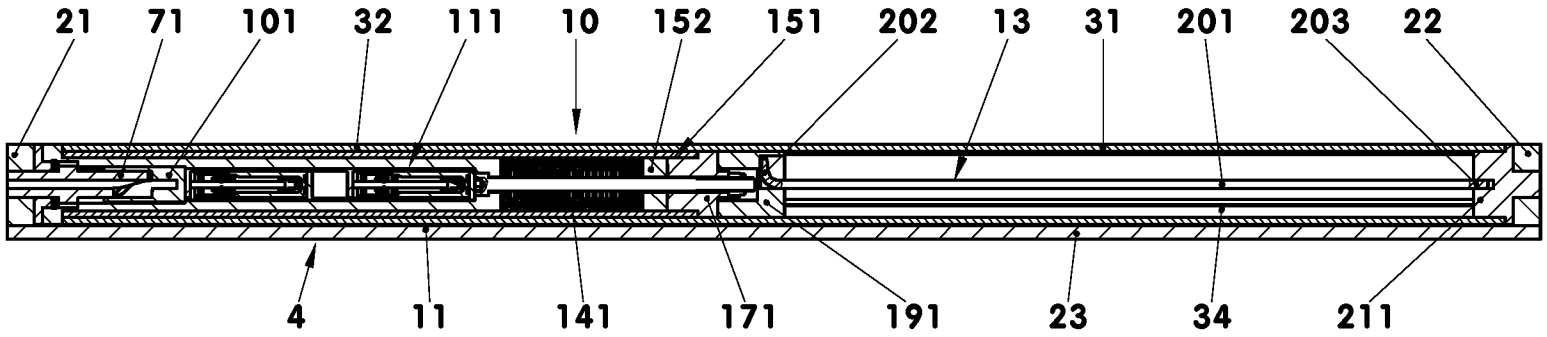
FIG. 3: Longitudinal section of the hinge shown in FIG. 1.
Figure 4:
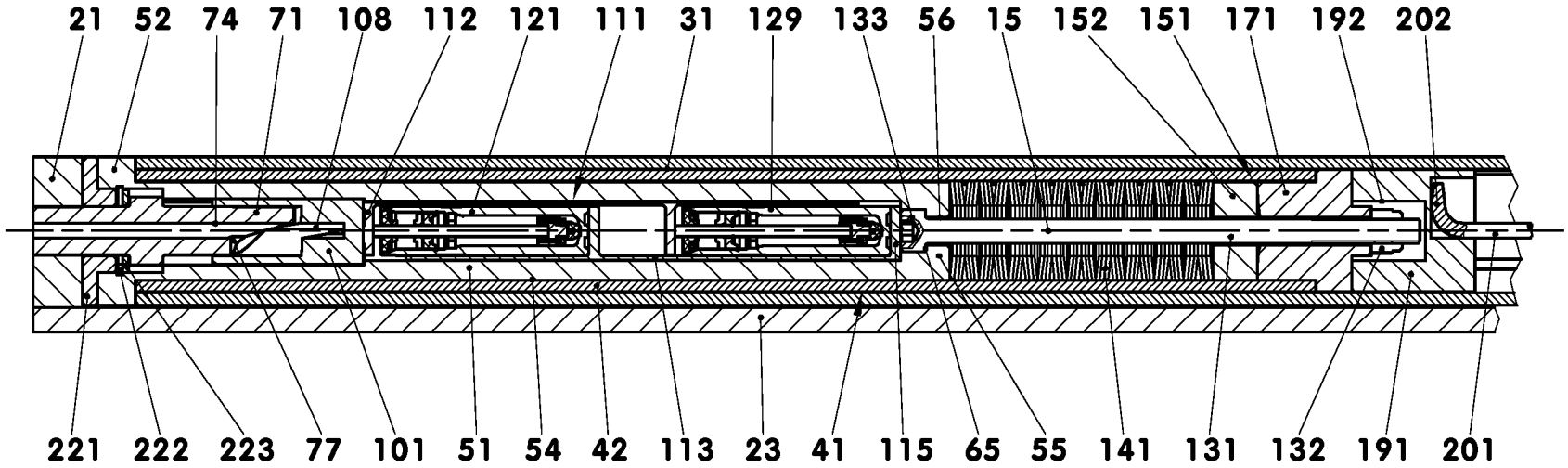
FIG. 4: Partial enlargement of the illustration shown in FIG. 3.

FIG. 2 shows an exploded view of the hinge (10). FIG. 3 shows a longitudinal section of the hinge (10). FIG. 4 shows an enlarged view of the left area of FIG. 3. In the hinge sleeve (31) there is a guide pin (71), which is held in a positive-locking manner in the first bracket (21) and which cooperates with a carrier (101) that is mounted in a longitudinally shifted manner in a receiving tube (51). Such carrier (101) actuates a damper assembly (111), which has two cylinder-piston units (121, 129) and two support shells (112, 113). A tension rod (131) is mounted in the receiving tube (51) and passes through a disk spring assembly (141), a control disk (152) and a drive disk (171) and is secured by a locking nut (132). The receiving tube (51) together with the disk spring assembly (141) and the control disk (152) is seated in a cylinder sleeve (42), on the end face of which the drive disk (171) abuts.

The drive disk (171) is coupled in a positive-locking manner to a transfer cylinder (191). Such transfer cylinder (191) is connected by a torsion element (201) to a torsion element receptacle (211) resting on the end face of the receiving sleeve (32). The torsion element receptacle (211) is seated in a positive-locking manner in the second bracket (22).

Figure 5:
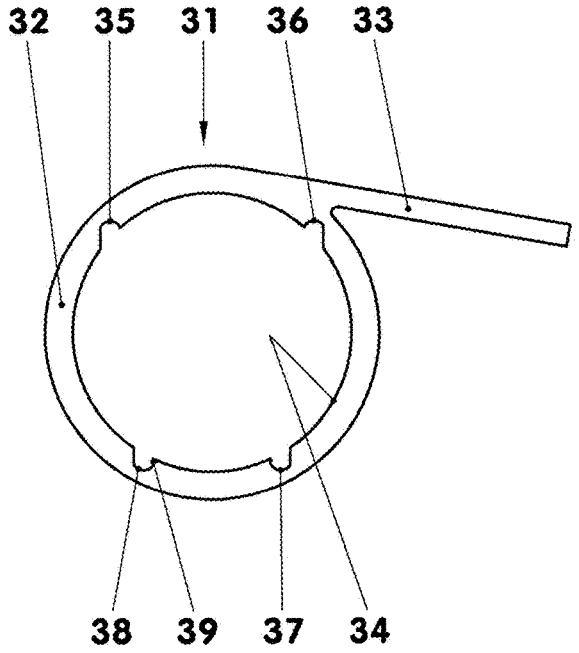
FIG. 5: Hinge sleeve.

FIG. 5 shows a front view of the hinge sleeve (31). The hinge sleeve (31) has four longitudinal grooves (35-38) on its inner wall (34). These are, for example, unevenly distributed on the inner wall (34). The longitudinal grooves (35, 36) located in the area of the connecting plate (33) enclose an angle of 91 degrees with one another, for example. The center of this angle lies in the pivot axis (15) of the hinge (10), which lies on the imaginary center line of the inner wall. The second (36) and the third longitudinal groove (37) form an angle of, for example, 106 degrees with respect to the specified apex. For example, the angle enclosed by the third longitudinal groove (37) and the fourth longitudinal groove (38) is 57 degrees. The flanks (39) of all longitudinal grooves (35-38) are oriented in a manner parallel to one another.

Figure 22:
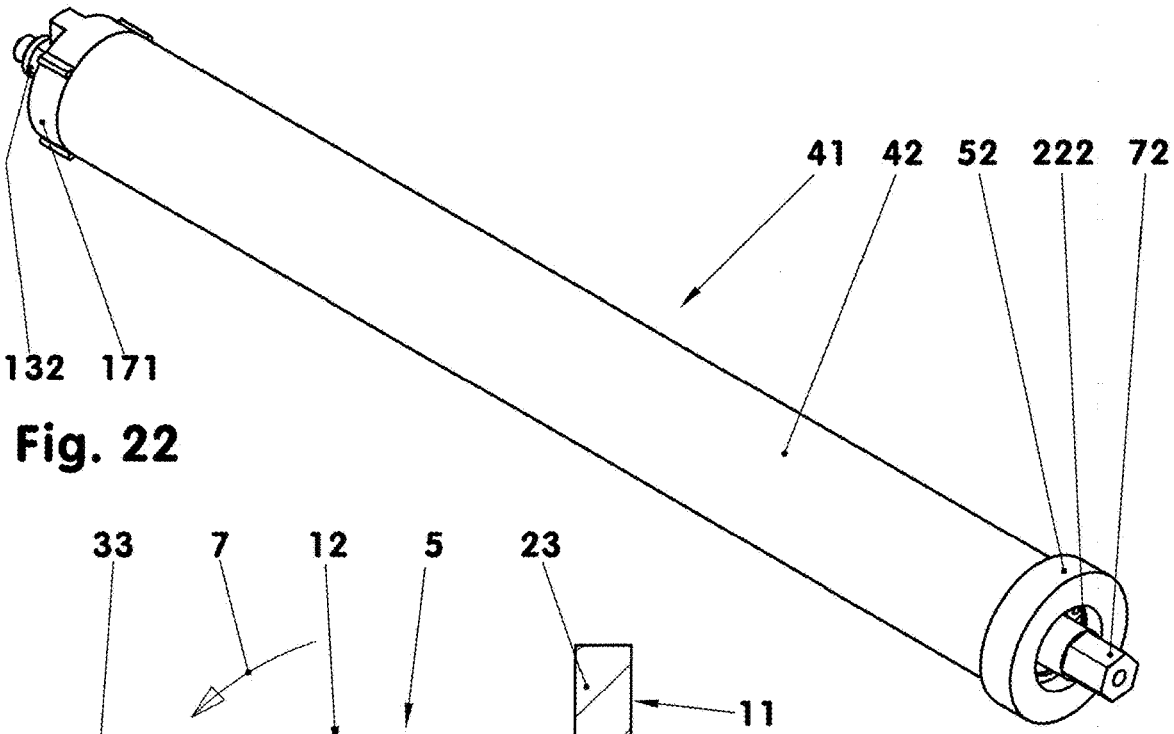
FIG. 22: Insert assembly.

An insert assembly (41) is located in the hinge sleeve (31), see FIG. 22. This includes the cylinder sleeve (42) and the components mounted in the cylinder sleeve (42). The receiving tube (51) abuts an annular collar (52) on one end face of the cylinder sleeve (42). The guide pin (71) protrudes therefrom. The drive disk (171) is arranged on the other end face of the cylinder sleeve (42).

Figure 6:
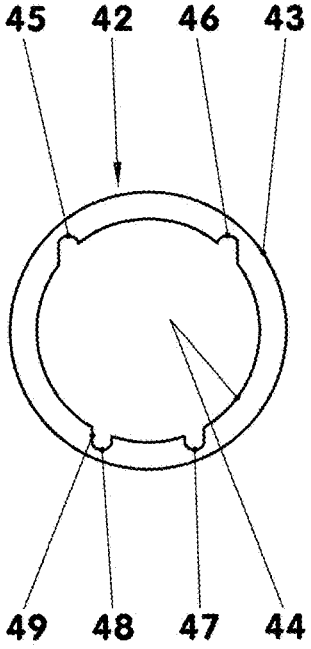
FIG. 6: Cylinder sleeve.

FIG. 6 shows the cylinder sleeve (42) as a single part. For example, the length of the cylinder sleeve (42) is 41% of the length of the hinge (10). Its diameter is, for example, 81% of the outer diameter of the hinge sleeve (31). The cylindrical sleeve (42) has a cylindrically formed, for example structure-free, lateral surface (43). The inner wall (44) has, for example, four cylinder sleeve longitudinal grooves (45-48). These are unevenly distributed on the cylinder sleeve inner wall (44). The first cylindrical sleeve longitudinal groove (45) and the second cylindrical sleeve longitudinal groove (46) enclose an angle of, for example, 88 degrees with one another. The apex of this angle lies on the pivot axis (15) of the hinge (10). Between the second longitudinal groove (46) and the third longitudinal groove (47) the angle is, for example, 113 degrees and between the third longitudinal groove (47) and the fourth longitudinal groove (48) the angle is, for example, 46 degrees. The flanks (49) of all cylinder sleeve longitudinal grooves (45-48) are oriented in a manner parallel to one another.

Figure 7:
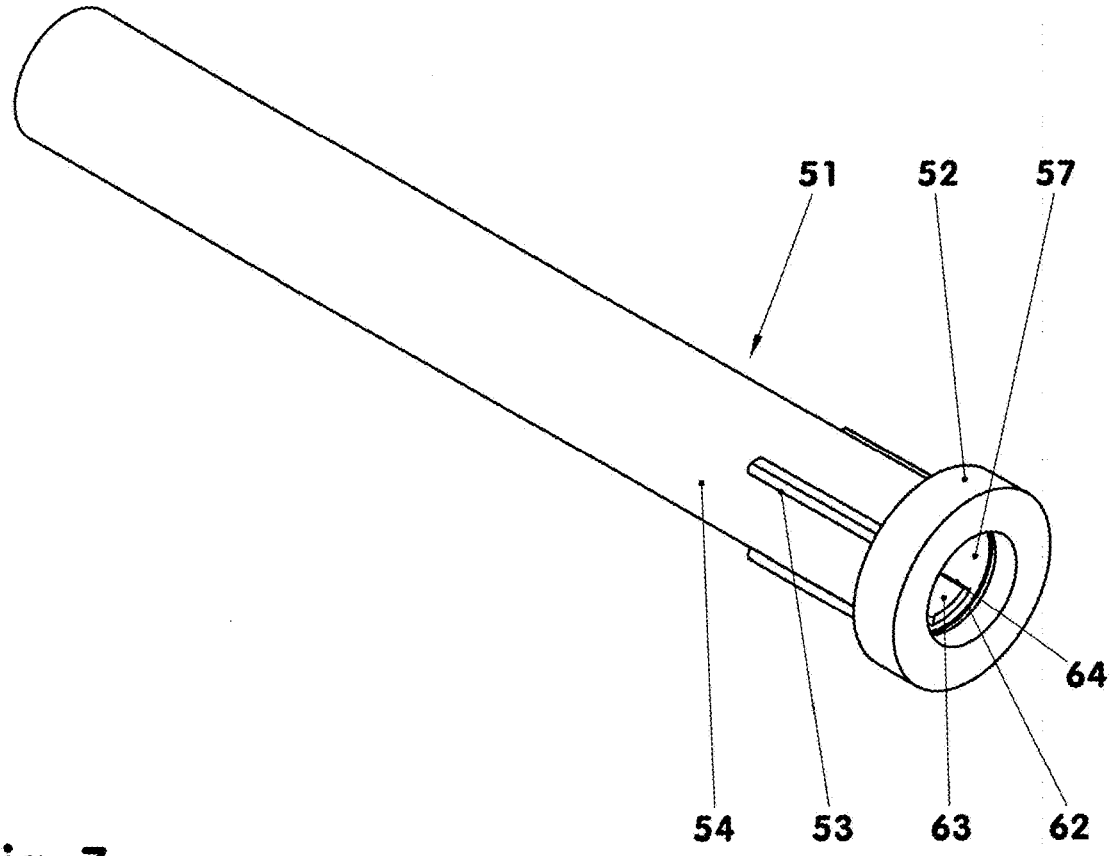
FIG. 7: Receiving tube.
Figure 8:
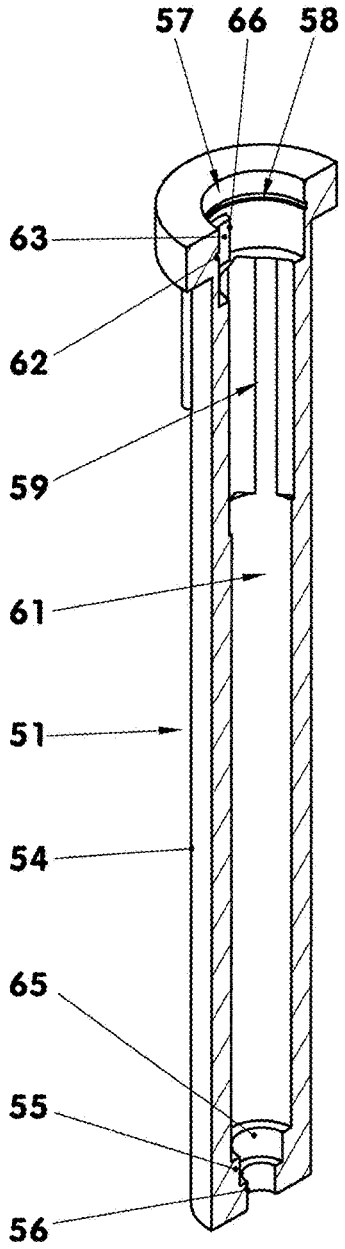
FIG. 8: Isometric longitudinal section through the receiving tube.
Figure 9:
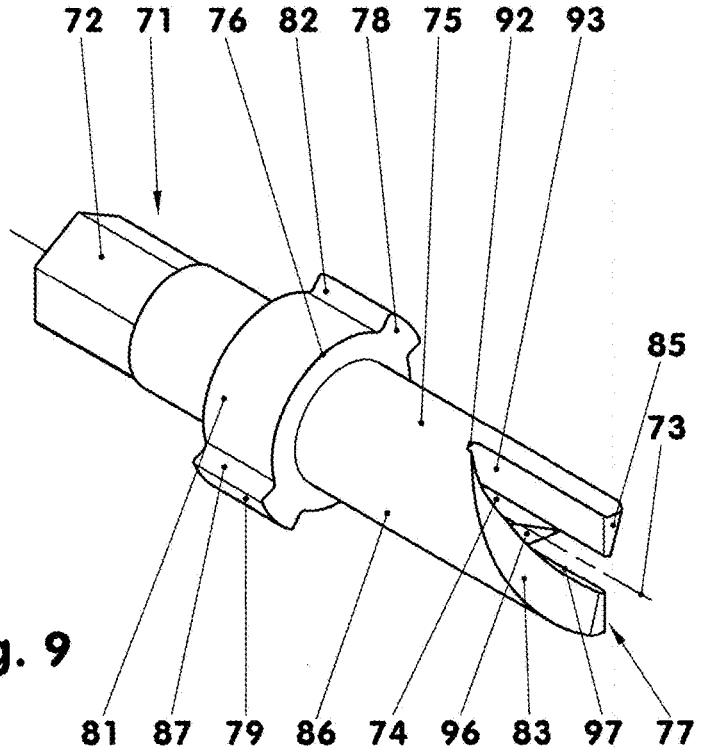
FIG. 9: Guide pin.

In the cylinder sleeve (42), the receiving tube (51), see FIG. 7, is held so that it cannot rotate. For this purpose, the receiving tube (51) has four insertion bars (53) bordering the annular collar (52). The spacing and formation of the insertion bars (53) correspond to the spacing and formation of the cylinder sleeve longitudinal grooves (45-48). The length of the insertion bars (53) is, for example, 15% of the length of the receiving tube (51).

In the exemplary embodiment, the length of the receiving tube (51) is 30% of the length of the hinge (10). For example, the diameter of the annular collar (52) corresponds to the diameter of the hinge sleeve (31). The receiving tube (51) has a cylindrical section (54) bordering the annular collar (52). A base (55) is arranged on its side turned away from the annular collar (52). This has a central aperture (56), see FIG. 8.

The inner surface (57) of the receiving tube (51) has three areas (58, 59, 61). A first area (58) borders the end on the annular collar side. Its length is, for example, 8% of the length of the receiving tube (51). This first area (58) is largely formed to be cylindrical in shape. It has a circumferential insertion groove (62) for a locking ring (222). In the illustration in FIG. 8, two opposing carrier lugs (63) are arranged below this insertion groove (62). The angle covered by a single carrier lug (63) between two, for example, radially oriented pivot boundary surfaces (64, 66) is, for example, 50 degrees in each case.

The second area (59) bordering the first area (58) is formed as an irregular hexagon socket area (59). For example, the opposing sides of the hexagonal socket area (59) are formed in a manner non-parallel to one another. For example, the length of the hexagon socket area (59) is 24% of the length of the receiving tube (51).

The third area (61), located between the second area (59) and the base (55), is formed to be cylindrical in shape. Its diameter is smaller than an inner circle of the hexagon socket area (59).

The guide pin (71) is seated in the receiving tube (51) and in the bracket (21). The guide pin (71) is shown as a single part in FIG. 9. In the exemplary embodiment, the guide pin (71) has a length of 52 mm and a maximum width of 14 millimeters. For example, it is point-symmetrical in any plane oriented in a manner normal to the pivot axis (15). The respective point of symmetry lies on the center line (73) of the guide pin (71), which coincides with the pivot axis (15), for example, when the guide pin (71) is installed. The guide pin (71) has a central, continuous longitudinal channel (74). The diameter of this longitudinal channel (74) corresponds, for example, to 17% of the maximum extension of the guide pin (71) in a plane normal to the center line (73).

The guide pin (71) has a bracket adapter (72), a cylinder section (75) with a load-bearing collar (76) and a first guide slide (77). The bracket adapter (72) is formed as a hexagon head in the illustration of FIG. 9. In the assembled state, this hexagon head is seated in the recess (24) of the bracket (21) so that it cannot rotate. The positive-locking anti-rotation protection between the guide pin (71) and the bracket (21) can also be formed as a triangle, quadrilateral, polygon, wedge connection, etc. This can be carried out regularly or irregularly.

The load-bearing collar (76), which is seated on the cylinder section (75), is formed to be largely cylindrical and has two radially outwardly projecting carrier pieces (78). These, for example, each cover a segment of 35 degrees. The diameter of the guide pin (71) in the area of the carrier pieces (78) is 20% larger than the diameter in the remaining area of the load-bearing collar (76). In the exemplary embodiment, the diameter of the load-bearing collar (76) is 40% larger than the diameter of the cylinder section (75) of the guide pin (71). The carrier piece lateral surfaces (79) are arranged coaxially to the load-bearing collar lateral surface (81). The carrier pieces (78) are each bounded by retaining surfaces (82, 87) oriented radially with respect to the center line (73). The two end faces of the carrier pieces (78) merge into the end faces of the load-bearing collar (76).

When the guide pin (71) is mounted, the first guide slide (77) projects into the interior space (13) of the hinge (10). The guide slide (77) has two guide rails (83, 96), whose geometrical relationship to one another corresponds to the aforementioned relationship for the entire guide pin (71). In the exemplary embodiment, the guide rails (83, 96) are formed right-handed. When the guide pin (71) is viewed from the end face (85), the individual guide rail (83; 96) rises in a helical counterclockwise direction around the center line (73). A left-handed formation of the guide slide (77) is also conceivable. The slope of the individual guide rail (83, 96) and thus of the guide slide (77) is the angle that the guide rail (83, 96) makes with a normal plane to the pivot axis (15) of the hinge (10). Such slope angle is 45 degrees in the exemplary embodiment. The single guide rail (83; 96) extends continuous and monotonic.

The width of the individual guide rail (83, 96) in a direction radial to the center line (73) is, for example, 10% greater than the diameter of the longitudinal channel (74). The single guide rail (83; 96) is bounded by straight lines oriented radially to the center line (73), which are tangent to the guide rail (83; 96) along its entire width. In the longitudinal direction (16) of the hinge (10), the length of the guide rails (83, 96) is, for example, 25% of the length of the guide pin (71). At the cylindrical lateral surface (86) of the guide pin (71), the angle enclosed by the single guide slide (83, 96) projected in a plane normal to the center line (73) is 168 degrees. The center point of this angle is on the center line (73).

At its foot end oriented in the direction of the load-bearing collar (76), the individual guide rail (83; 96) ends in an undercut (92). A boundary surface (93; 97) adjoins each of these. In the exemplary embodiment, such boundary surfaces (93, 97) are parallel to a radial plane containing the center line (73). They may also be formed as partial surfaces of a common radial plane containing the center line (73).

In the mounted state, the guide pin (71) is secured in the receiving tube (51) by the locking ring (222) engaging behind the load-bearing collar (76). The carrier pieces (78) lie in the intermediate spaces between the carrier lugs (63). For example, the guide pin (71) is pivotable relative to the receiving tube (51) about the pivot axis (15) through an angle of 95 degrees. Such pivoting angle sub-range is bounded, for example, in both pivot directions by the stop of the carrier pieces (78) on the carrier lugs (63).

Figure 10:
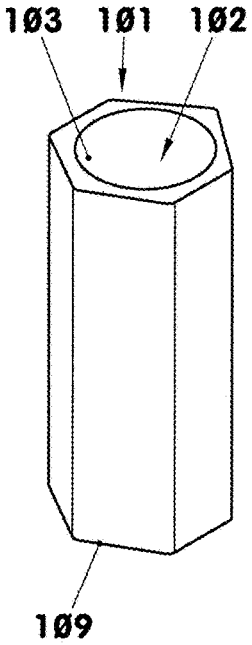
FIG. 10: Carrier.
Figure 11:
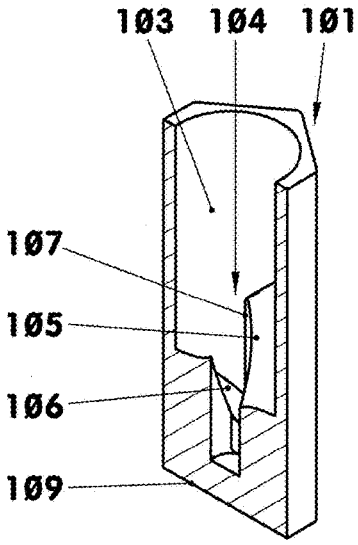
FIG. 11: Longitudinal section of the carrier.

Furthermore, a carrier (101) is mounted in the receiving tube (51), see FIGS. 10 and 11. The carrier (101) has the shape of a hexagonal pin. The hexagonal cross-sectional surface of the hexagonal pin is irregular in shape. In the exemplary embodiment, such cross-sectional surface is geometrically similar to the cross-sectional surface of the hexagon socket area (59) of the receiving tube (51). In the assembled state, the carrier (101) is seated in the second area (59) of the receiving tube (51) so that it cannot rotate. The anti-rotation protection can also be formed differently. Due to the irregularly formed positive-locking connection between the carrier (101) and the receiving tube (51), a faulty assembly of the hinge (10) is prevented. The two interacting components can also be formed differently for this purpose. In the exemplary embodiment, the maximum corner dimension of the cross-sectional surface is 46% of the length of the carrier (101) in the longitudinal direction (16).

The carrier (101) has a central depression (102) oriented in the longitudinal direction (16). Such depression (102) is cylindrical at least in the guide area (103) oriented in the direction of the guide pin (71). In the exemplary embodiment, the diameter of such guide area (103) is one-third of the length of the carrier (101). For example, it is 2% larger than the diameter of the cylinder section (75) of the guide pin (71).

A second guide slide (104) is arranged in the depression (102). The second guide slide (104) has two helically formed slide rails (105, 106). Each point of one slide rail (105; 106) is formed to be point-symmetrical with respect to a point of the other slide rail (106; 105). The respective point of symmetry lies on the pivot axis (15) of the hinge (10). In the exemplary embodiment, both slide rails (105, 106) have the same width as the guide rails (83, 96). The slide rails (105, 106) have the same slope direction as the guide rails (83, 96). The amount of their slope corresponds to the amount of the slope of the guide rails (83). In the exemplary embodiment, a respective guide rail (83) of the guide pin (71) can thus abut a slide rail (105; 106) of the carrier (101) in a contact zone formed as a contact surface (95). The contact zones between the guide rails (83) and the slide rails (105, 106) can also be contact lines or contact points. For this purpose, for example, the individual guide rail (83) or the individual slide rail (105; 106) can be formed to be bar-like or pin-shaped.

A radial surface (107, 108) is arranged between each of the two slide rails (105, 106). Such radial surface (107: 108) lies, for example, in a plane that is spanned by the pivot axis (15) and a straight line oriented radially thereto.

The end face of the carrier (101) turned away from the depression (102) is formed as an abutment surface (109). The abutment surface (109) is oriented in the direction of a damper assembly (111) arranged in the receiving tube (51), see FIGS. 3 and 4. Such damper assembly (111) comprises two load-bearing shells (112, 113) that can be shifted relative to one another and in which two cylinder-piston units (121, 129) are mounted.

Figure 12:
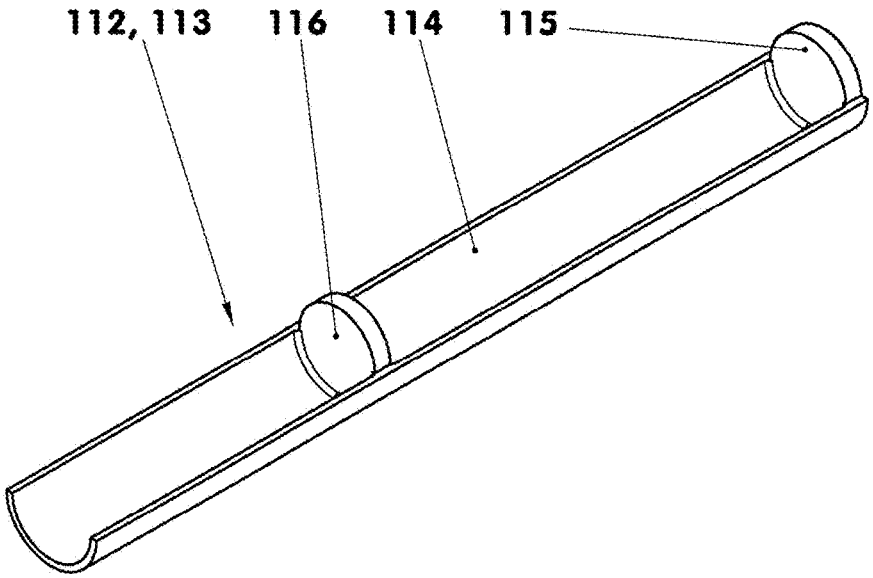
FIG. 12: Support shell.

The two load-bearing shells (112, 113), see FIG. 12, are, for example, formed to be identical. The single load-bearing shell (112; 113) has a channel-shaped shell body (114) and two support disks (115, 116) oriented in a manner normal to the longitudinal direction (15). A first support disk (115) is arranged flush with the end of the shell body (114). In the exemplary embodiment, the second support disk (116) is spaced apart from the first support disk (115) by 60% of the length of the load-bearing shell (112; 113) oriented in the longitudinal direction (16). Both support disks (115, 116) are formed on the respective shell body (114). All end faces of the support disks (115, 116) are arranged in a manner plane-parallel to one another and normal to the pivot axis (15) of the hinge (10).

Figure 13:
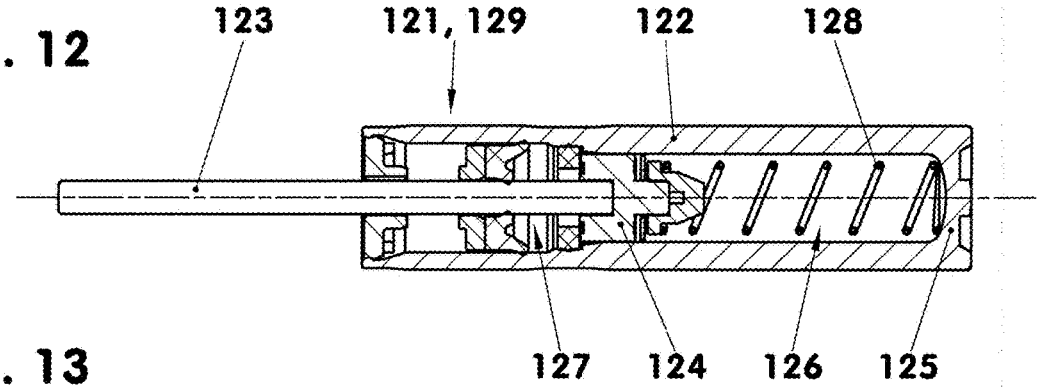
FIG. 13: Longitudinal section of the cylinder-piston unit.

FIG. 13 shows a longitudinal section of a cylinder-piston unit (121; 129). The two cylinder-piston units (121: 129) are formed identically to one another in the exemplary embodiment. They each have a cylinder (122) in which a piston (124) connected to a piston rod (123) can be moved between two end positions. For example, as the piston (124) moves in the direction of the cylinder base (125), hydraulic oil is displaced from a displacement chamber (126) into an equalizing chamber (127) on the piston rod side. Thereby, a return spring (128) is compressed. After the piston rod (123) is relieved, the return spring (128) shifts the piston (124) to its initial position. Thereby, the oil flows through and/or around the piston (124) from the equalizing chamber (127) into the displacement chamber (126). The two cylinder-piston units (121; 129) are also referred to hereinafter as dampers (121; 129).

In the exemplary embodiment, the first cylinder-piston unit (121) is located between the first support disk (115) of the first load-bearing shell (112) and the second support disk (116) of the second load-bearing shell (113). Thereby, the piston rod (123) contacts the first support disk (115) and the cylinder base (125) contacts the second support disk (116).

In the illustration of FIG. 4, the piston rod (123) of the second cylinder-piston unit (129) points in the same direction as the piston rod (123) of the first cylinder-piston unit (121). For example, it points in the direction of the carrier (101). However, the two piston rods (123) can point in different directions. The second cylinder-piston unit (129) is arranged between the second support disk (116) of the first load-bearing shell (112) and the first support disk (115) of the second load-bearing shell (113). The two load-bearing shells (112, 113) are thus arranged opposite to one another and surround both cylinder-piston units (121, 129). Thus, the two cylinder-piston units (121; 129) are connected to one another in parallel. It is also conceivable to form the damper assembly (111) with a single cylinder-piston unit (121; 129). Also, the two cylinder-piston units (121, 129) can be arranged in series with one another.

When the hinge (10) is closed, the hinge (10) is in the initial position (4), both cylinder-piston units (121; 129) are retracted. The damper assembly (111) abuts the abutment surface (109) of the carrier (101) with the first support disk (115) of the first load-bearing shell (112). The first support disk (115) of the second load-bearing shell (112) supports the damper assembly (111) on the base (55) of the receiving tube (51).

A tension rod (131) is seated in the aperture (56) of the base (55), which is formed as a counterbore. The tension rod (131) is located with the tension rod head (133) in the depression (65) of the aperture (56). The tension rod (131) penetrates a spring assembly (141) and a control assembly (151). Here, the tension rod (131), which is formed as a screw, for example, is fixed by means of a locking nut (132). In the exemplary embodiment, the spring assembly (141) consists of eighteen groups of disk springs (142) each arranged in threes. When the hinge (10) is closed, the disk springs (142) are preloaded by means of the tension rod (131) and the locking nut (132), for example.

The control assembly (151) comprises the control disk (152) and the drive disk (171) cooperating therewith. For this purpose, the drive disk (171) has a first control slide (176) and the control disk (152) has a second control slide (153).

Figure 14:
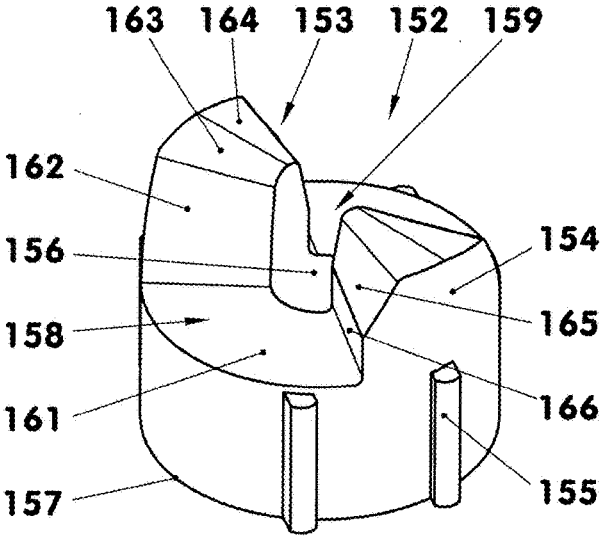
FIG. 14: Isometric view of the control disk.
Figure 15:
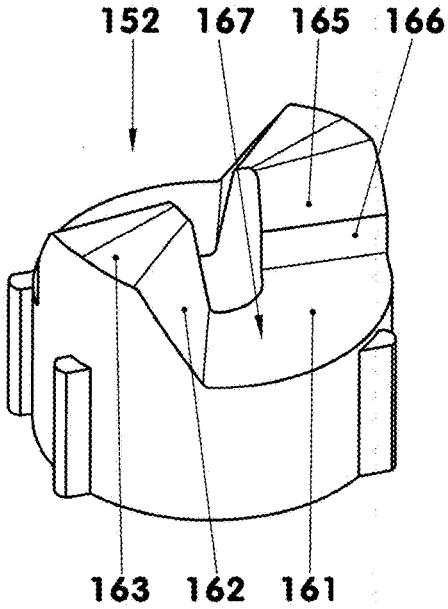
FIG. 15: Side view to FIG. 14.

FIGS. 14 and 15 show an isometric front view and an isometric side view of the control disk (152). The control disk (152) has on its lateral surface (154), for example, four longitudinal bars (155) that, in the mounted state, engage in the longitudinal grooves (45-48) of the cylinder sleeve (42). It also has a central longitudinal aperture (156), through which the tension rod (131) passes in the assembled state. The control disk (152) has an abutment side (157) oriented in a manner normal to the pivot axis (15). The disk spring assembly (141) abuts the abutment side (157) in the assembled state. On the side turned away from the abutment side (157), the control disk (152) carries the second control slide (153). The second control slide (153) has two control rails (158, 159). These point in the direction of the drive disk (171). The control rails (158, 159) are arranged symmetrically relative to one another with respect to the pivot axis (15). Each point of a first control rail (158; 159) is point-symmetrical to exactly one point of the second control rail (159; 158). The point of symmetry is always on the pivot axis (15). The width of the single control rail (158; 159) in a direction normal to the pivot axis (15) is, for example, 29% of the outer diameter of the cylinder sleeve (42). For example, the single control rail (158; 159) has a left-hand slope. In the exemplary embodiment, the slope of the second control slide (153) is directed counter to the slope direction of the guide slides (77, 104).

For example, each of the control rails (158, 159) has three sections (161-163). Such sections (161-163) are formed as continuously differentiable surfaces that merge into one another.

A first section (161) of the respective control rail (158; 159) lies in a normal plane to the pivot axis (15). This first section (161) has the smallest distance to the abutment side (157). In each control rail (158; 159), for example, such first section (161) covers a center angle of 106 degrees. Such first section (161) is a freewheel section (161), for example. The control rails (158, 159) can also be formed without such first section (161).

The respective second section (162) sweeps through a normal plane to the pivot axis (15), for example, projects an angle of 22 degrees, the apex of which lies on the pivot axis (15). A tangential plane to such second section (162) encloses an angle of 60 degrees with a normal plane to the pivot axis (15), for example. This is the slope of the second control slide (153) in such second section (162). In the longitudinal direction, the length of the second section (162) is, for example, 90% of the total length of the control rail (158; 159) in such direction.

The respective third section (163) encloses an angle of 11 degrees with a normal plane to the longitudinal axis. In the exemplary embodiment, such third section (163) sweeps through an angle of 21 degrees in a projection on a normal plane to the pivot axis (15). The apex of such angle lies on the pivot axis (15). The control slide (153) can also be formed without the third sections (163).

An open space (164) abuts the third section (163) of the control rails (158, 159). This lies in a normal plane to the pivot axis (15). The distance between the plane of the open space (164) and the plane of the first section (161) is, for example, one-third of the diameter of the lateral surface (154) of the control disk (152). In the exemplary embodiment, the open space (164) covers an angle of 17 degrees. The apex of such angle lies on the pivot axis (15).

A transition surface (165) and a stop surface (166) are arranged between the open space (164) and the first section (161) of the other control rail (158; 159).

The transition surface (165) has a slope oriented in a manner counter to the slope of the second section (162) and the third section (163). It encloses an angle of 58 degrees with a normal plane to the pivot axis (15). In a projection on such a normal plane, the transition surface (165) covers a sector of 14 degrees. The apex of the limiting angle lies on the pivot axis (15). Such transition surface (165) can be a stop surface or an open space.

The stop surface (166) lies in a radial plane to the pivot axis (15). For example, a straight line spanning such plane contains the pivot axis (15). The other straight line spanning the plane is oriented radially to the pivot axis (15). The transitions between the individual surfaces (164-166) and the transitions to the control rails (158, 159) are formed to be rounded.

The control rails (158, 159), the transition surfaces (165) and the stop surfaces (166) bound two control grooves (167) of the control disk (152). It is also conceivable to design the control disk (152) with a control cam. With a formation with a control cam, for example, the open space has the smallest distance to the abutment side. The respective first section of the control slide then bounds the end face of the control slide. For example, with such a formation, the control rails (158, 159) are arranged to be right-handed.

Figure 16:
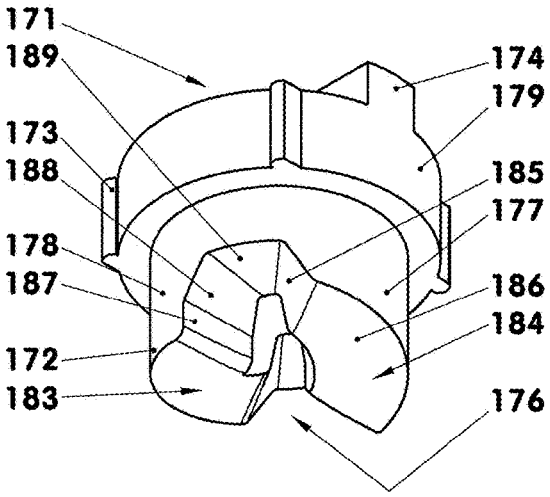
FIG. 16: Drive disk.
Figure 17:
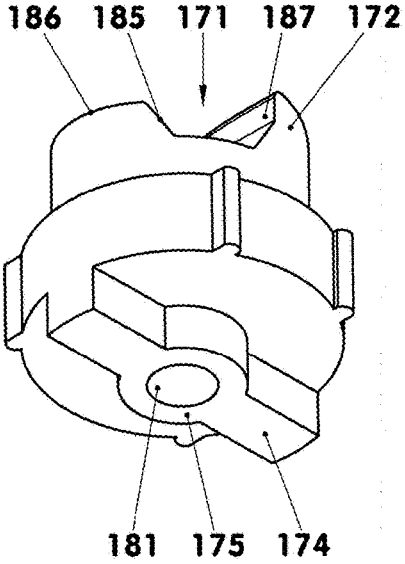
FIG. 17: Rear view of the drive disk shown in FIG. 16.

The drive disk (171) is shown as an individual part in FIGS. 16 and 17. Thereby, FIG. 16 shows an isometric view of the side of the drive disk (171) pointing in the direction of the control disk (152). The drive disk (171) has a first longitudinal section (177) having a cylindrical lateral surface (178) and a second longitudinal section (179), the cross-sectional surface of which is greater than the cross-sectional surface in the first longitudinal section (177). A longitudinal bore (181) oriented in the longitudinal direction (16) penetrates the entire drive disk (171). The cross-section of such longitudinal bore (181) corresponds to the cross-section of the longitudinal aperture (156) of the control disk (152).

The cross-sectional surface in the first longitudinal section (177) is smaller than the envelope inner contour of the cylinder sleeve (42). The length of the first longitudinal section (177) oriented in the longitudinal direction (16) is, for example, half the total length of the drive disk (171) in such direction. The outer contour of the second longitudinal section (179) has four circumferentially distributed longitudinal bars (173). All such longitudinal bars (173) are oriented in the longitudinal direction (16). In the assembled state, such longitudinal bars (173) engage in the longitudinal grooves (35-38) of the hinge sleeve (31).

The end face of the first longitudinal section (177) oriented to the control disk (152) carries the first control slide (176). The first control slide (176) has two drive rails (183, 184) that are arranged in a manner offset from one another by an angle of 180 degrees about the pivot axis (15). Each point of a first drive path (183) is thus point-symmetrical to a point of a second drive path (184). Thereby, the respective point of symmetry is located on the pivot axis (15). For example, the width of the single drive rail (183; 184) oriented in the radial direction corresponds to the width of the single control rail (158; 159).

The single drive rail (183; 184) has a release area (185) and a ramp area (186). Such two areas (185, 186) are formed as continuously differentiable surfaces with rounded transitions. In the exemplary embodiment, they are formed to be left-handed helical.

The release area (185) encloses an angle of 60 degrees with a normal plane to the pivot axis (15). In the longitudinal direction, the length of this release area (185) is 29% of the length of the first longitudinal section (177). The release area (185) projected in a normal plane to the pivot axis (15) covers an angle of 15 degrees, the apex of which lies on the pivot axis (15).

In the ramp area (186) the single drive rail (183; 184) rises to the left. In the longitudinal direction (16), its length is, for example, a quarter of the length of the first longitudinal section (177). For example, in a projection on a plane oriented in a manner normal to the longitudinal direction (16), such ramp area (186) covers a sector of 116 degrees. The apex of the angle bounding such sector lies on the pivot axis (15). The drive disk (171) can also be formed without the ramp area (186).

A blocking surface (187) abuts the ramp area (186). This is formed as a radially oriented surface. It lies in a plane that is spanned by the pivot axis (15) and a straight line oriented in a manner normal to it. In the longitudinal direction (16), the length of this blocking surface (187) is, for example, a quarter of the length of the first longitudinal section (177).

A transition surface (188) borders the blocking surface (187). Such transition surface (188) encloses an angle of 58 degrees with a normal plane to the pivot axis (15). The slope of the transition surface (188) is oriented in a manner counter to the slope of the release area (185). When projected in a normal plane to the pivot axis (15), the transition surface (188) covers an angle of 14 degrees in the exemplary embodiment. The transition surface (188) can be a stop surface or an open space.

An open space (189) connects the transition surface (188) to the release section (185) of the other drive rail (184; 183). Such release area (189) lies in a plane oriented in a manner normal to the longitudinal direction (16). Its distance from the second longitudinal section (179) is less than the distance of the ramp area (186) from the second longitudinal section (179). Such open space (189) covers an angle of 35 degrees. The apex of such angle lies on the pivot axis (15). The transitions of the surfaces (187-189) and the transitions of such surfaces (186-189) to the drive rails (183, 184) are formed to be rounded, for example.

The two drive rails (183, 184), the blocking surfaces (187) and the transition surfaces (188) bound two drive pins (172) of the drive disk (171). In the exemplary embodiment, such drive pins (172) are formed to be complementary to the control grooves (167). Instead of a drive pin (172), the drive disk (171) can also have a drive groove. This is then formed, for example, in a manner complementary to the described control pin. The control slides (153, 176) are then formed, for example, in the same direction as the guide slides (77, 104).

A carrier bar (174) is arranged on the end face of the drive disk (171) turned away from the first control slide (176). This is formed, for example, as a continuous transverse bar (174). Centrally, it has a support cylinder (175) surrounding the longitudinal bore (181). When the hinge (10) is mounted, the locking nut (132) of the tension screw (131) is supported on the support cylinder (175).

Figure 18:
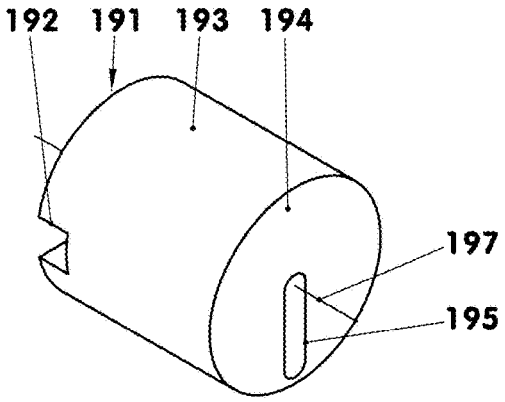
FIG. 18: Transfer cylinder.
Figure 19:
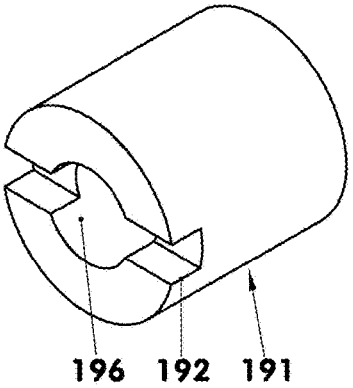
FIG. 19: Rear view of the transfer cylinder.

FIGS. 18 and 19 show the transfer cylinder (191). The carrier bar (174) engages in a carrier recess (192) of the transfer cylinder (191). When rotating about the pivot axis (15), the transfer cylinder (191) and the drive disk (171) are connected to one another in a positively locking manner. The locking nut (132) is seated in the carrier recess (192), which has a centrally arranged cylindrical depression (196) for this purpose. The transfer cylinder (191) has a cylindrically formed lateral surface (193). The outer diameter of the transfer cylinder (191) is, for example, slightly smaller, for example two tenths of a millimeter, than the diameter of the envelope inner contour of the hinge sleeve (31). The positive-locking fit for preventing rotation of the drive disk (171) relative to the transfer cylinder (191) can also be formed differently.

FIG. 19 shows an isometric view of the transfer cylinder (191) from the end face (194) turned away from the control assembly (151). The transfer cylinder (191) has a transverse slot (195) that straddles the center line (197) located in the pivot axis (15) of the hinge (10). This transverse slot (195) is formed to be longitudinally grooved.

Figure 20:
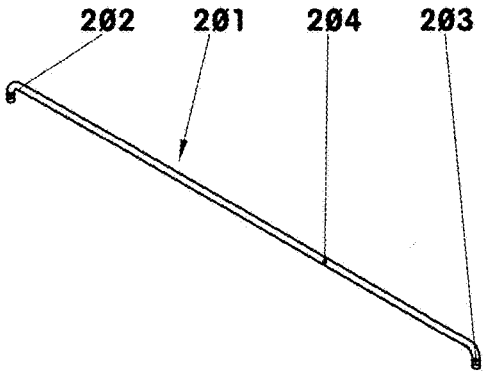
FIG. 20: Torsion element.

The torsion element (201), see FIG. 20, is mounted in the transverse slot (195). Such torsion element (201) is formed as a U-shaped bent rod with a central rod piece (204). In the exemplary embodiment, the torsion element (201) has a length equal to 47% of the length of the hinge (10). For example, it is made of a wire-shaped spring steel, whose two ends (202, 203) formed as insert arms (202, 203) are angled in the same direction. One of the insert arms (202) is seated in the transverse slot (195). A different fixing of the torsion element (201) in the transfer cylinder (191) is also conceivable. The torsion element (201) can also be formed to be Z-shaped, wherein the two ends (202, 203) point in different directions. In the exemplary embodiment, the torsion element (201) has a circular cross-sectional surface. However, the torsion element (201) can also be made of a flat material. It is also conceivable to use a helically wound torsion element (201).

Figure 21:
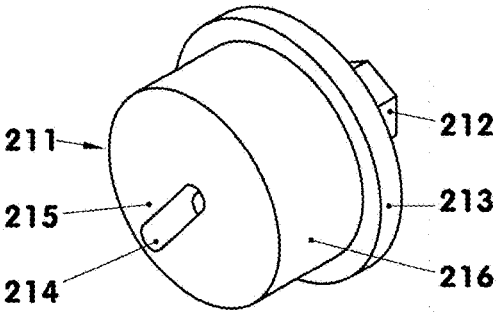
FIG. 21: Torsion element receptacle.

The other end (203) of the torsion element (201) is seated in the torsion element receptacle (211). In FIG. 21, the torsion element receptacle (211) is shown as a single part. The end face (215) of the torsion element receptacle (211) oriented in the direction of the control assembly (151) has a receiving groove (214). The receiving groove (214) is formed, for example, like the transverse slot (195) of the transfer cylinder (191). The specified end face (215) bounds a cylindrically formed insert section (216). The diameter of this insert section (216) corresponds, for example, to the diameter of the transfer cylinder (191).

When the hinge is assembled, the insert section (216) of the torsion element receptacle (211) is seated in the hinge sleeve (31). A ring adapter (213) bordering the insert section (216) abuts the hinge sleeve (31) at the end face. The outer diameter of the ring collar (213) corresponds to the outer diameter of the hinge sleeve (31). The length of the annular collar (213) in the longitudinal direction (16) is, for example, one-tenth of its diameter.

On the side turned away from the control assembly (151), the torsion element receptacle (211) has a hexagonal pin (212). Such hexagonal pin (212) forms the second bracket adapter (212), which is seated in the bracket (22) when the hinge (10) is mounted. Another design of the positive-locking fit between the torsion element receptacle (211) and the bracket (22) is also conceivable.

When the hinge (10) is assembled, the insert assembly (41), for example, is initially assembled as a pre-assembly unit. For example, the tension screw (131) is initially inserted into the receiving tube (51), such that the head (133) of the tension screw (131) abuts internally on the base depression (65) of the receiving tube (51) and the tension screw (131) passes through the aperture (56).

Such components (51, 131) can be inserted into the cylinder sleeve (42) until the cylinder sleeve (42) abuts the annular collar (52) of the receiving tube (51). Thereby, the insertion bars (53) of the receiving tube (51) engage in the cylinder sleeve longitudinal grooves (45-48). The disk spring assembly (141) is threaded onto the tension screw (131), such that it abuts the base (55) of the receiving tube (51). Furthermore, the control disk (152) is placed on the tension rod (131), the position of which control disk relative to the cylinder sleeve (42) is determined by its longitudinal bars (155).

The drive disk (171) is pushed onto the control disk (152) and onto the tension rod (131) until the second longitudinal section (179) abuts the end face of the cylinder sleeve (42). Thereby, the drive disk (171) is rotated such that the control assembly (151) has the shortest length in the longitudinal direction (16). For example, the drive pins (172) are seated in the control grooves (167). Then, the locking nut (132) can be screwed onto the tension screw (131). For example, it is screwed tight enough to give the spring assembly (141) a defined preload.

The two cylinder-piston units (121, 129) are inserted into one support shell (112) and the second support shell (113) is placed on top. Then, the damper assembly (111) can be inserted into the receiving tube (51).

The carrier (101) is inserted into the receiving tube (51) such that its guide slide (104) points to the open end of the receiving tube (51). The positive-locking centering secures the position of the carrier (101) relative to the receiving tube (51).

The guide pin (71) is inserted into the receiving tube (51) with its guide slide (77) first. The washer (223) is pushed onto the load-bearing collar (76). The locking ring (222) is subsequently inserted into the insertion groove (62) in the receiving tube (51) above the load-bearing collar (76). The guide pin (71) is then secured against falling out. For example, the guide pin (71) is rotated relative to the receiving tube (51) in the opening direction (7) of the hinge (10) until it abuts the carrier lugs (63).

The hinge sleeve (31) can be pushed onto this insert assembly (41), see FIG. 22, until its end face abuts the annular collar (52) of the receiving tube (51). The transfer cylinder (191) is inserted into the free end of the hinge sleeve (31) with the carrier depression (192) in front. The transfer cylinder (191) is aligned, for example, by means of the torsion element (201). The torsion element (201) is inserted into the transfer cylinder (191), for example, in such a manner that the rod piece (204) arranged between the ends (202, 203) lies on the pivot axis (15). Instead of a single torsion element (201), a plurality of torsion elements (201) can also be used, for example arranged in a manner off-center.

The torsion element receptacle (211) is placed on the free end of the torsion element (201). The torsion element receptacle (211) is inserted loosely, for example with a sliding clearance fit, into the hinge sleeve (31).

The two bracket adapters (72, 212) projecting outwards are finally inserted into the brackets (21, 22). The two brackets (21, 22) are connected to one another, for example, by means of the fastening plate (23). A different order of assembly is also conceivable.

The hinge (10) mounted in this way can e.g. be installed in a cabinet. Thereby, for example, the locking plate (23) is fastened to the furniture body with the brackets (21, 22). The connecting plate (33) of the hinge sleeve (31) is hinged to a door or a lid. However, it is also conceivable to attach the fastening plate (23) with the brackets (21, 22) to the lid or to the door and the connecting plate (33) to the furniture body. The hinge (10) can be arranged horizontally, for example in the case of an oven door, or vertically, for example in the case of a cabinet door. An inclined arrangement of the hinge (10) is also conceivable. For example, installation takes place with the lid or door open. In the case of a vertical installation, the hinge (10) can be used for both a right-hand stop and a left-hand stop of the door or lid. For example, depending on the application, the hinge is installed with the first bracket adapter (72) or with the second bracket adapter (212) facing upwards.

After installation, the oven door is, for example, in an operating end position (5), with which the oven door is swung open, for example, by an angle of 95 degrees from the vertical, closed initial position (4).

In such operating end position (5), the piston rods (123) of the cylinder-piston units (121, 129) are extended. The two support shells (112, 113) are shifted relative to one another in the longitudinal direction (16). For example, the second support shell (113) is supported with its first support disk (115) on the base (55) of the receiving tube (51). The first support disk (115) of the first support shell (113112) abuts the abutment surface (109) of the carrier (101).

The carrier (101) is shifted in the direction of the open end of the receiving tube (51). Due to the positive-locking fit between the carrier (101) and the receiving tube (51), the rotational position of the two parts in relation to one another cannot be changed.

Figure 23:
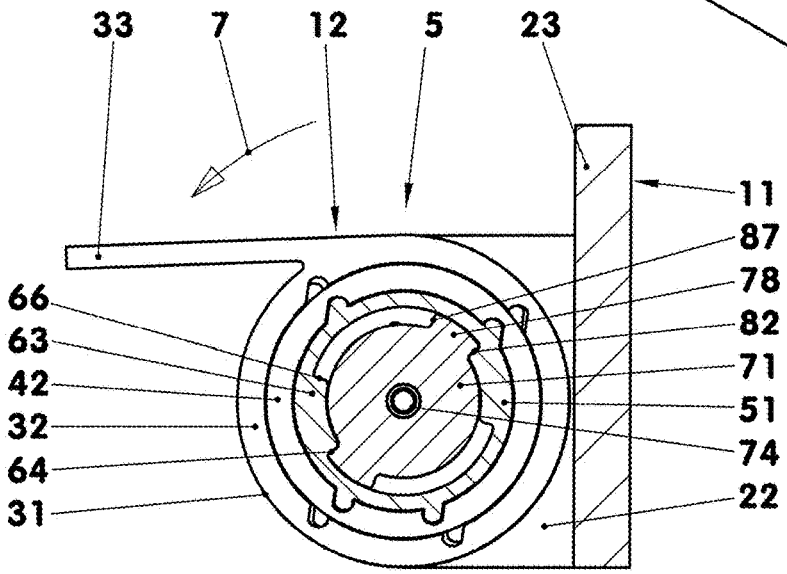
FIG. 23: Cross-section of the hinge in the operating end position.

The carrier pieces (78) of the guide pin (71) each abut with a retaining surface (82) a carrier lug (63) of the receiving tube (51), see FIG. 23. The sectional plane of this illustration lies normal to the pivot axis (15) in the end plane of the cylinder tube (42) and the hinge sleeve (31). In the exemplary embodiment, in a top view of the hinge (10) from the guide pin (71), the retaining surfaces (82) located on the right abut the pivot limiting surfaces (64) of the carrier lugs (63) located on the left. The radial surfaces (107, 108) of the carrier (101) can abut the boundary surfaces (93, 97) of the guide pin (71). However, the radial surfaces (107, 108) can also be spaced from the boundary surfaces (93, 97).

Figure 26:
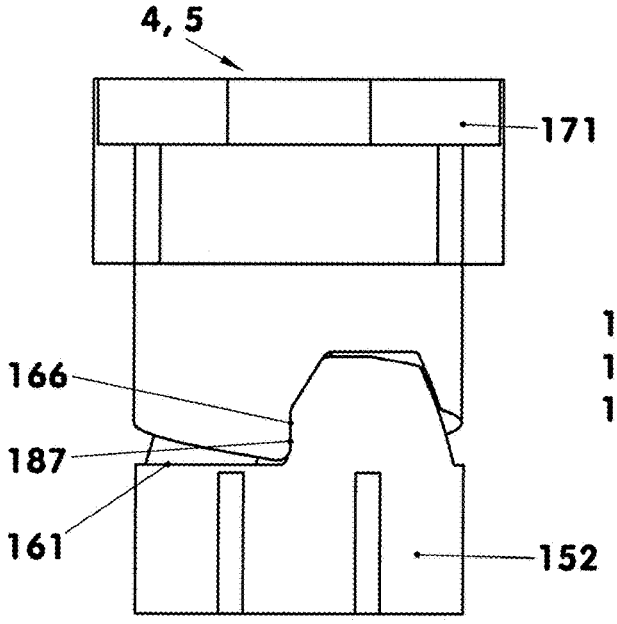
FIG. 26: Control disk and drive disk in the pivoting range between the initial position and the operating end position.
Figure 27:
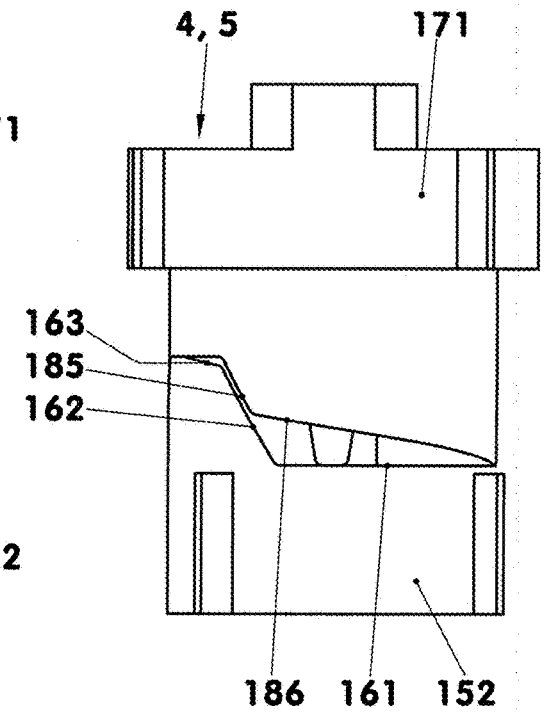
FIG. 27: Side view to FIG. 27.

The receiving tube (51) is seated in the cylinder sleeve (42) so that it cannot rotate. The disk spring assembly (141) is preloaded with the value set during assembly. The control disk (152) is also seated in the cylinder sleeve (42) so that it cannot rotate. Thus, the control disk (152) is rotationally fixedly coupled to the carrier (101). For example, the drive disk (171) abuts the stop surface (166) of the control disk (152) with the blocking surface (187). FIGS. 26 and 27 show such position in a front view and in a side view. For example, the torsion element (201) is unloaded. However, the hinge (10) can also be constructed in such a manner that the torsion element (201) is relaxed in a closed initial position (4) of the hinge (10) or at an opening angle between the initial position (4) and the operating end position (5).

In such operating end position (5), the open door is in a stable state. The torque caused by the gravity of the door and acting in the opening direction is counteracted by the bearing forces of the brackets (21, 22).

Figure 24:
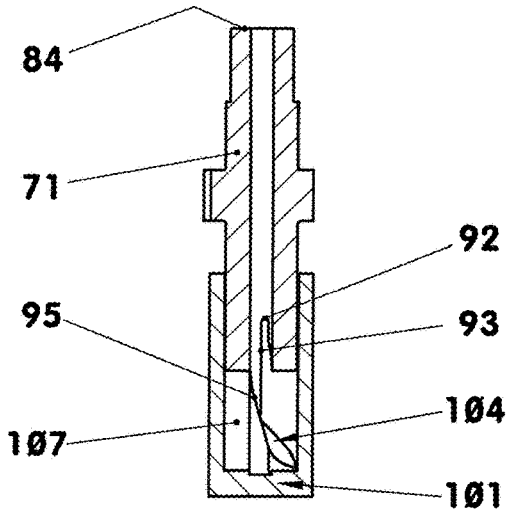
FIG. 24: Sectional view of the carrier and the guide pin in the initial position.
Figure 25:
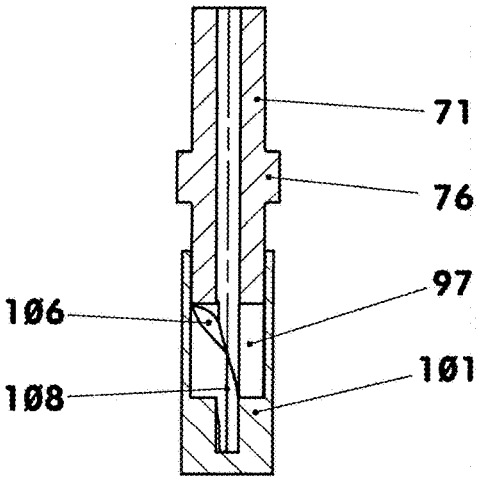
FIG. 25: Illustration from FIG. 25 with the sectional plane pivoted 90 degrees.

When the oven door is closed, it is pivoted relative to the body counter to the opening direction (7) from the operating end position (5) to the initial position (4). In the top view on the side of the guide pin (71), the connecting plate (33) on the lid side is pivoted clockwise relative to the brackets (21, 22). The guide pin (71) is fixed. The connecting plate (33) is used to pivot the hinge sleeve (31) relative to the brackets (21, 22). The hinge sleeve (31) carries along the drive disk (171), which continues to abut the stop surface (166) of the control disk (152) with the blocking surface (187). The rotary movement of the oven door is transferred from the control disk (152) to the cylinder sleeve (42) and from this to the receiving tube (51). The receiving tube (51) carries along the carrier (101), the guide slide (104) of which slides along the guide slide (77) of the guide pin (71). This is shown in FIGS. 24 and 25 in two sectional views oriented transversely to one another. Thereby, the carrier (101) is shifted in the longitudinal direction (16) of the hinge (10) in the direction turned away from the guide pin (71). The carrier (101) shifts the first support shell (112) with its abutment surface (109) relative to the second support shell (113) supported on the base (55) of the receiving tube (51). The first support shell (112) loads the piston rods (123) of the cylinder-piston units (121; 129). The piston rods (123) are retracted. In the cylinder-piston units (121, 129), oil is displaced from the displacement chamber (126) into the equalizing chamber (127). The retracting movement of the piston rod (123) and thus the movement of the carrier (101) is delayed. The closing movement of the oven door is damped.

When the drive disk (171) rotates, the transfer cylinder (191) is carried along. The torsion element (201) is twisted relative to the fixed torsion element receptacle (211). This results, for example, in an additional delay of the closing movement.

The closing movement is completed as soon as the two hinge arms (11, 12) are in the closed initial position (4) relative to one another. Such initial position (4) may be self-locking.

The damping of the pivoting movement can be limited to a partial pivoting angle bordering the initial position (4), for example. For this purpose, the guide slides (77, 104) of the guide pin (71) and of the carrier (101) can be formed in such a manner that no shifting of the carrier (101) occurs in an angular range bordering the operating position (5). For example, for this purpose, the contact area of both guide slides lies in a normal plane to the pivot axis (15).

The hinge (10) can have an additional draw-in device that loads the hinge in the direction of the initial position (4). For this purpose, the hinge (10) can comprise, for example, a spring that loads the hinge in the direction of the initial position (4) at least in a partial pivoting angle bordering the initial position.

In the initial position (4), the piston rods (123) of the cylinder-piston units (121, 129) are retracted. The guide slides (77, 104) of the guide pin (71) and the carrier (101) abut one another, wherein the single radial surface (107; 108) of the carrier (101) is spaced from the boundary surfaces (93, 97) of the guide pin (71). For example, the retaining surfaces (82) of the guide pin (71) are spaced from the pivot boundary surfaces (64) of the receiving tube (51). For example, in the initial position, the receiving tube (51) abuts with the pivot boundary surfaces (66) of the carrier lugs (63) the retaining surfaces (87) of the carrier pieces (78) of the guide pin (71). However, the closed position of the hinge (10) can also be determined by the contact of the lid or door with the furniture body.

The disk spring assembly (141) is loaded by means of the preload on the assembly side. The control disk (152) abuts with the stop surface (166) the blocking surface (187) of the drive disk (171). The torsion element (201) is twisted, see FIG. 3.

When the oven door is opened from the initial position (4) to the operating end position (5), the oven door is pivoted counterclockwise in the opening direction (7) in a top view of the fixed guide pin (71). Such opening movement takes place in a pivoting angle sub-range bordering the initial position (4). The hinge sleeve (31) fastened to the oven door by means of the connecting plate (33) is also pivoted. The hinge sleeve (31) takes along the drive disk (171). The carrier bar (174) of the drive disk (171) pivots the transfer cylinder (191) along with it. The torsion element (201) is relieved and supports the pivoting movement of the drive disk (171). With the release area (185), the drive disk (171) abuts the second section (162) of the control slide (153) of the control disk (152). The control disk (152) is carried along and pivots the cylinder sleeve (42) about the pivot axis (15) by means of its longitudinal bars (155), which are connected in a positive-locking manner to the cylinder sleeve (42).

The cylinder sleeve (42) in turn drives the receiving tube (51) connected to it in a positive-locking manner, wherein the carrier (101) mounted in the receiving tube (51) slides along the guide pin (71). During such pivoting movement, the carrier (101) is rotationally fixedly coupled to the second arm (12). If necessary, the two guide slides (77, 104) can become detached from one another, for example during rapid opening.

The cylinder-piston units (121; 129) are relieved. The return springs (128) push the pistons (124) in the direction of the extended end position. Thereby, the two piston rods (123) displace the two support shells (112, 113) relative to one another. At the same time, the first support shell (112) shifts the carrier (101) in the direction of the guide pin (71). The pivoting movement is completed when the guide pin (71) abuts with its carrier pieces (78) the carrier lugs (63) of the receiving tube (51). When the oven door is opened quickly, after the specified pivot position has been reached, the carrier (101) can be pressed even further axially in the direction of the open end of the receiving tube (51) by means of the cylinder-piston units (121, 129), until the two guide slides (77, 104) once again abut one another. The hinge is then in the operating end position (5), as described above.

If the hinge (10) is to be opened further, for example in the event of panic, the oven door is pushed down further, for example by hand. Thereby, the connecting plate (33) with the hinge sleeve (31) is pivoted further in the opening direction (7) about the pivot axis (15) relative to the brackets (21, 22). The hinge sleeve (31) takes along the drive disk (171). The drive disk (171) is connected to the transfer cylinder (191) in a positive-locking manner. The torsion element (201) is twisted relative to the fixed torsion element receptacle (211). Thereby, the energy stored in the torsion element (201) is increased.

The drive disk (171) abuts the second section (162) of the control slide (153) of the control disk (152) with the release area (185) in a first contact zone (231). The control disk (152) is seated in a positive-locking and longitudinally shifted manner in the cylinder sleeve (42), which in turn is connected in a positive-locking manner to the receiving tube (51). The receiving tube (51) abuts with its carrier lugs (63) the carrier pieces (78) of the fixed guide pin (71). This prevents the further pivoting of the receiving tube (51) relative to the guide pin (71) when the oven door is opened beyond the operating end position (5). As a result of this locking, the control disk (152) is also prevented from pivoting about the pivot axis (15) via the cylinder sleeve (42). The carrier (101) is thus rotationally fixedly coupled to the first arm (11) of the hinge (10) in such pivoting angle sub-range.

Figure 28:
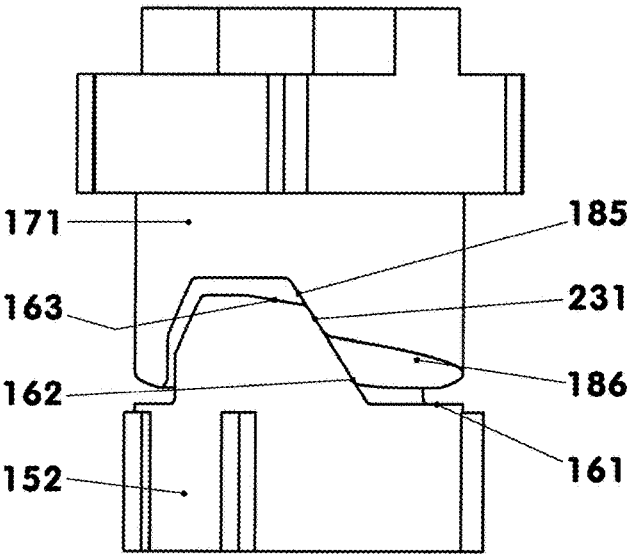
FIG. 28: Control disk and drive disk at an opening above the operating end position.

When the oven door is further loaded in the opening direction (7), the drive rails (183, 184) of the drive disk (171) slide along the control rails (158, 159) of the control disk (152), see FIG. 28. The abutting guide slides (153, 176) form at least a first contact zone (231). The drive disk (171) displaces the control disk (152), which is shifted in the longitudinal direction (16) in the direction of the receiving tube (51). The drive pins (172) slide along the inclined flank of the control grooves (167) formed by the control rails (158, 159). In these contact zones (231), the slope of the control slides (153, 176) relative to a normal plane to the pivot axis (15) is greater than the slope of the guide slides (77, 104) and less than 90 degrees. The contact zones between the drive disk (171) and the control disk (152) can be surfaces, lines or points. A formation with a single contact zone is also conceivable. When the control disk (152) is shifted, the disk spring assembly (141) is loaded. The disk springs (142) are compressed. The operator feels an increasing resistance. With the position of the control assembly (151) shown in FIG. 28, the maximum pivoting angle of the two hinge arms (11, 12) relative to one another can be reached. The hinge (10) has then reached the second position (6).

Figure 29:
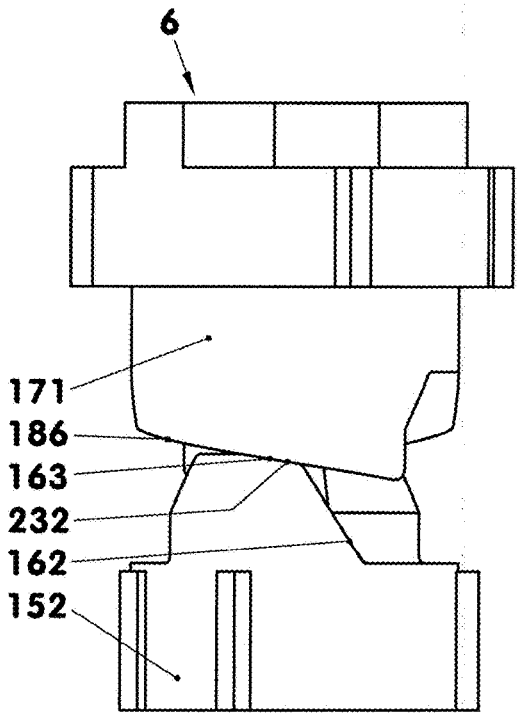
FIG. 29: Control disk and drive disk at an opening in the second position.

In the exemplary embodiment, the hinge (10) is further pivotable. As soon as the ramp area (186) of the drive rails (183, 184) has reached the third section (163) of the control disk (152) during further pivoting in the opening direction (7), the resistance to be overcome by the operator is reduced due to the lower slope of the further contact zone (232). This is shown in FIG. 29. In such contact zone (232) of the control slides (153, 176), for example, the amount of the slope of the control slides (153, 176) with respect to the normal plane to the pivot axis (15) is less than the amount of the slope of the control slides (153, 176) in the first contact zone (231) with respect to such normal plane. For example, the amount of the slope of the control slides (153, 176) in the further contact zone (232) is less than the amount of the slope of the guide slides (77, 104) relative to a normal plane to the pivot axis (15). The control disk (152) continues to be shifted in the direction of the receiving tube (51), wherein the disk spring assembly (141) is further compressed. The carrier (101) is further rotationally fixedly coupled to the first arm (11) of the hinge (10). The oven door can then be opened further, for example to an angle of 180 degrees. In the illustrated exemplary embodiment, in such second position (6), a return force can act on the oven door in the direction of the operating end position (5). The two control slides (153, 176) abut one another in the further contact zone (232) bordering the second position (6), for example.

The hinge (10) can be formed such that the oven door assumes a stable position in the described second position (6). For this purpose, for example, the slope of the two control slides (153, 176) abutting one another relative to a normal plane to the pivot axis (15) is less than 10 degrees.

When the oven door is closed from the second position (6) in the direction of the operating end position (5), the connecting plate (33) with the receiving sleeve (32) is pivoted in the opposite direction. The hinge sleeve (31) pivots the drive disk (171), which carries along the transfer cylinder (191). The relaxing torsion element (201) supports the pivoting movement of the drive disk (171). The drive disk (171) slides along the control disk (152). Thereby, the control disk (152) is pressed against the drive disk (171) by means of the relaxing disk spring assembly (141). For example, the axial force of the disk spring assembly (141) $F_{FP}$ is designed such that, when the control slides (153, 176) make contact in the further contact zone (232), the following applies:

$$F_{FP}>=F_D*S*r_{FK}*(\sin(2*\alpha)-\mu_{FK}*(1-\cos(2*\alpha))/(r_{SK}*(\sin(2*\beta)-\mu_{SK}*(1-\cos(2*\beta))))$$

with $F_{FP}$: Force of the disk spring assembly (141) in the longitudinal direction (16) of the pivot axis (15) in Newtons;

$F_D$: Sum of the forces of the dampers (121, 129) in the longitudinal direction (16) of the pivot axis (15) in Newtons;

S: Safety factor $r_{FK}$: mean radius of the guide slides (77, 104) in millimeters;

$r_{SK}$: mean radius of the control slide (153, 176) in millimeters;

$\alpha$: Slope angle of the guide slides (77, 104) relative to a normal plane to the pivot axis (15), in degrees or in radians;

$\beta$: Slope angle of the control slides (153, 176) relative to a normal plane to the pivot axis (15) in the area of the further contact zone (232), in degrees or in radians;

$\mu_{FK}$: Coefficient of static friction of the guide slides (77, 104), dimensionless;

$\mu_{SK}$: Coefficient of static friction of the control slides (153, 176) in the area of the further contact zone (232), dimensionless.

The force of the disk spring assembly (141) acting in the longitudinal direction (16) is greater than or equal to the product of the sum of the damper forces in the longitudinal direction (16), the ratio of the mean radii of the guide slides (77, 104) and the control slides (153, 176), a safety factor and a factor dependent on the geometric configuration of the guide slides (77, 104) and control slides (153, 176). The latter factor is the quotient of the difference, specified in the numerator, between the sine of twice the slope angle of the guide slides (77, 104) and the difference, multiplied by the coefficient of static friction, between one and the cosine of twice the slope angle of the guide slides (77, 104) along with the difference, specified in the denominator, of the sine of twice the slope angle of the control slides (153, 176) in the further contact zone (232) and the difference, multiplied by the coefficient static friction, of one and the cosine of twice the slope angle of the control slides (153, 176) in the further contact zone (232).

In the exemplary embodiment, the axial force of the single damper (121; 129) is for example 300 Newtons. For example, the mean radius of the guide slides (77, 104) is 3.2 millimeters, and the mean radius of the control slides (153, 176) is 7.5 millimeters in the exemplary embodiment. Assuming a coefficient of static friction of 0.1 for a lubricated pairing of both the guide slides (77, 104) and the control slides (153, 176) and a safety factor of 3, this results in a minimum force of the disk spring assembly (141) of 1870 Newtons, taking into account the other values specified. In the exemplary embodiment, the disk spring assembly (141) has an axial force of 2250 Newtons.

With the above design of the minimum spring force of the spring assembly (141) for the further contact zone (232), the corresponding condition for the first contact zone (231) is also realized. In the exemplary embodiment, the slope angle of the control slides (153, 176) present in the contact zone (231) requires a lower minimum axial force of the spring assembly (141) compared to the design value, for example, with the same coefficient of static friction. Thus, the formula specified above can also be used to design a hinge (10), which has only a first contact zone (231). Such first contact zone (231) then borders the second position (6).

Under the effect of the internal return force applied by the spring assembly (141), in the exemplary embodiment the cylinder sleeve (42), the receiving tube (51) and the carrier (101) remain at rest relative to the guide pin (71). At least once the release area (185) abuts the second area (162), the amount of the slope of the control slides (153, 176) is greater than the amount of the slope of the guide slides (77, 104). The drive disk (171) pivots relative to the control disk (152) until the blocking surfaces (187) engage the stop surfaces (166). The oven door has then once again reached its operating end position (5).

In an embodiment of the hinge (10) without the ramp area (186) and/or without the third section (163) of the second control slide (153), the torsion element (201) can be omitted, if necessary.

From this stable operating end position (5), the oven door can either be closed to the initial position (4) or opened to the second position (6). The procedure for these operations is as described above.

The opening of the hinge (10) can also have three or more steps. For example, a door can be opened in 30 degree or 45 degree increments.

In the exemplary embodiment, the pivoting sub-range bordering the initial position (4) and the pivoting sub-range bordering the second position (6) adjoin one another in the operating end position (5). However, it is also conceivable to arrange, for example, a freewheel area between the two pivoting sub-ranges. For this purpose, for example, the sector covered by the drive pins (172) about the pivot axis (15) is smaller than the sector covered by the control grooves (167) by at least a few angular degrees.

Figure 30:
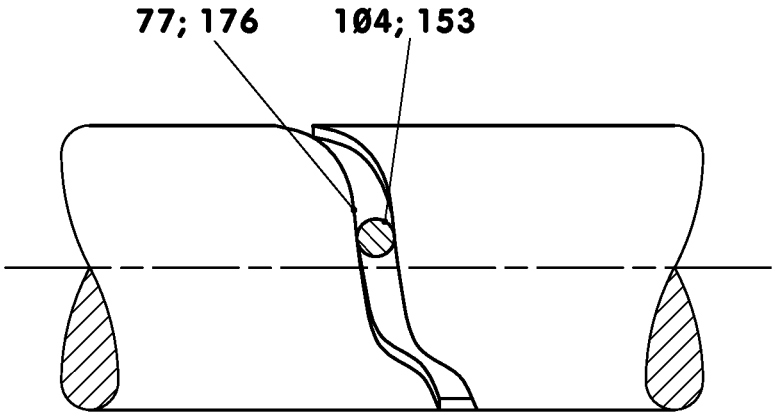
FIG. 30: Threaded spindle.

Instead of the control disk (152) and the drive disk (171), a threaded spindle and an engagement pin contacting it or a spindle nut contacting it can also be used. This is shown in FIG. 30. Thereby, either the threaded spindle or the respective contacting counterpart carries the first control slide (176). The respective other component then has the respective counter slide, for example the second control slide (153). In this exemplary embodiment, the contact between the two control slides (153, 176) can also be a point contact, a line contact or a surface contact. In addition or alternatively, the guide pin (71) and the carrier (101) can also be replaced by a threaded spindle and a counterpart contacting the latter.

Combinations of the individual embodiments are also conceivable.

LIST OF REFERENCE SIGNS

4 Initial position
5 Operating end position
6 Second position
7 Opening direction
10 Hinge
11 First arm, first hinge arm
12 Second arm, second hinge arm
13 Hinge interior space
15 Pivot axis, longitudinal axis
16 Longitudinal direction
21 Bracket
22 Bracket
23 Fastening plate
24 Recess
31 Hinge sleeve

32 Receiving sleeve
33 Connecting plate
34 Inner wall
35 Longitudinal groove
36 Longitudinal groove
37 Longitudinal groove
38 Longitudinal groove
39 Flanks
41 Insert assembly
42 Cylinder sleeve
43 Lateral surface
44 Cylinder sleeve inner wall
45 Cylinder sleeve longitudinal groove
46 Cylinder sleeve longitudinal groove
47 Cylinder sleeve longitudinal groove
48 Cylinder sleeve longitudinal groove
49 Flanks
51 Receiving tube
52 Collar, annular collar
53 Insertion bars
54 Cylinder section
55 Base
56 Aperture
57 Inner surface
58 First area of (57)
59 Second area of (57), hexagon socket area
61 Third area of (57), cylindrical area
62 Insertion groove
63 Carrier lugs
64 Pivot boundary surfaces
65 Depression of (56)
66 Pivot boundary surface
71 Guide pin
72 Bracket adapter, hexagonal pin
73 Center line
74 Longitudinal channel
75 Cylinder section
76 Load-bearing collar
77 First guide slide
78 Carrier pieces
79 Carrier piece lateral surfaces
81 Load-bearing collar lateral surface
82 Retaining surfaces
83 Guide rail
84 End face
85 End face
86 Lateral surface
87 Retaining surface
92 Undercut
93 Boundary surface
95 Contact surface
96 Guide rail
97 Boundary surface
101 Carrier
102 Depression
103 Guide area
104 Second guide slide
105 Slide rail
106 Slide rail
107 Radial surface
108 Radial surface
109 Abutment surface
111 Damper assembly
112 Load-bearing shell, support shell
113 Load-bearing shell, support shell
114 Shell body
115 Support disk, first support disk
116 Support disk, second support disk
121 Cylinder-piston unit, damper
122 Cylinder
123 Piston rod
124 Piston
125 Cylinder base
126 Displacement chamber
127 Equalizing chamber
128 Return spring
129 Cylinder-piston unit, damper
131 Tension rod, screw
132 Locking nut
133 Tension rod head
141 Spring assembly, disk spring assembly
142 Disk springs
151 Control assembly
152 Control disk
153 Second control slide
154 Lateral surface
155 Longitudinal bars
156 Longitudinal aperture
157 Abutment side
158 Control surfaces, control rail
159 Control surfaces, control rail
161 First section, freewheel section
162 Second section
163 Third section
164 Fourth section, open space
165 Transition surfaces
166 Stop surfaces
167 Control grooves
171 Drive disk
172 Drive pin
173 Guide bars, longitudinal bars
174 Transverse bar, carrier bar
175 Middle area of (174), support cylinder
176 Control slide, first control slide
177 First longitudinal section
178 Lateral surface of (177)
179 Second longitudinal section
181 Longitudinal bore
183 Drive rail
184 Drive rail
185 Release area
186 Ramp area
187 Blocking surface
188 Transition surface
189 Open space
191 Transfer cylinder
192 Crossbar recess Carrier recess
193 Lateral surface of (191) 194 End face
195 Insert groove, transverse slot
196 Cylindrical depression
197 Center line
201 Torsion element, torsion bar
202 Insert arm, ends of (201)
203 Second end of (201)
204 Rod piece
211 Torsion element receptacle
212 Hinge adapter, hexagonal pin, bracket adapter
213 Ring adapter, annular collar, support ring
214 Receiving groove
215 End face
216 Insertion section
221 Intermediate ring
222 Locking ring
223 Washer

231 First contact zone
232 Further contact zone

The invention claimed is:

1. A hinge (10), comprising two arms (11, 12) that can be pivoted relative to one another through a non-zero pivoting angle range between a first position (4), and a second position (6), wherein a first of the two arms (11) has a first guide slide (77), wherein the hinge (10) has a second guide slide (104) that can be shifted along a pivot axis (15) and that can make contact with the first guide slide (77), wherein, movement of the two arms (11, 12) towards the first position (4) causes at least one cylinder-piston unit (121; 129) to be loaded by the second guide slide (104), wherein the second guide slide (104) can be rotationally fixedly coupled to a second of the two arms (12) in a first pivoting angle sub-range bordering the first position (4) and to the first of the two arms (11) in a second pivoting angle sub-range bordering the second position (6), wherein the first pivoting angle sub-range and the second pivoting angle sub-range are non-overlapping portions of the non-zero pivoting angle range, and wherein the hinge (10) has a first control slide (176) rigidly connected to the second arm (12) and a second control slide (153) that makes contact with the first control slide (176) and that is non-rotatably coupled to the second guide slide (104).

2. The hinge (10) according to claim 1, wherein the first guide slide (77), the second guide slide (104), the first control slide (176), and the second control slide (153) are coaxial to the pivot axis (15).

3. The hinge (10) according to claim 1, wherein the contact between the first control slide (176) and the second control slide (153) is spring-loaded.

4. The hinge (10) according to claim 3, wherein the control slides (153, 176) are contacting each other in a contact zone (231; 232) when the two arms (11, 12) are in the second position (6), wherein a slope angle of the guide slides (77, 104) is defined as an angle of the guide slide (77, 104) relative to a normal plane to the pivot axis (15), wherein a slope angle of the control slides (153, 176) is defined as an angle relative to the normal plane to the pivot axis (15) in the contact zone (232), wherein the spring force loading the control slides (153, 176) is greater than or equal to the product of the sum of the forces of the at least one damper (121; 129), the ratio of the mean radii of the guide slides (77, 104) and the control slides (153, 176) with respect to the pivot axis (15), a safety factor and a factor dependent on the geometric configuration of the guide slides (77, 104) and control slides (153, 176), wherein such latter factor is the quotient of the difference, specified in the numerator, between the sine of twice the slope angle of the guide slides (77, 104) and the difference, multiplied by the coefficient of static friction, between one and the cosine of twice the slope angle of the guide slides (77, 104) along with a difference, specified in the denominator, of the sine of twice the slope angle of the control slides (153, 176) in the contact zone (232) and the difference, multiplied by the coefficient static friction, of one and the cosine of twice the slope angle of the control slides (153, 176) in such further contact zone (232).

5. The hinge (10) according to claim 1, wherein the first pivoting angle sub-range and the second pivoting angle sub-range border one another in an operating end position (5) located between the first position (4) and the second position (6).

6. The hinge (10) according to claim 1, wherein the at least one cylinder-piston unit (121; 129) comprises two hydraulic cylinder-piston units (121; 129) with spring return, arranged coaxially with respect to the pivot axis (15) and operable in parallel.

7. The hinge (10) according to claim 1, wherein the control slides (153, 176) comprise at least a first contact zone (231), in which an amount of a slope of the control slides (153, 176) relative to a normal plane to the pivot axis (15) is greater than an amount of a slope of the guide slides (77, 104) relative to the normal plane.

8. The hinge (10) according to claim 1, wherein at least one torsion element (201) is connected to the first arm (11) and to the second arm (12).

9. The hinge (10) according to claim 8, wherein the at least one torsion element (201) is a torsion bar (201) clamped on both sides.

10. The hinge (10) according to claim 1, wherein the guide slides (77, 104), the control slides (153, 176) and the at least one cylinder-piston unit (121; 129) are parts of a common insert assembly (41).

11. The hinge (10) according to claim 1, wherein a slope of the guide slides (77, 104) relative to a normal plane to the pivot axis (15) and a slope of the control slides (153, 176) relative to the normal plane to the pivot axis (15) are formed in opposite directions.

12. The hinge (10) according to claim 1, wherein at least one of the first guide slide (77), the second guide slide (104), the first control slide (176) and the second control slide (153) is part of a threaded spindle that cooperates with a workpiece carrying the respective counter slide (104; 77; 153; 176).

* * * * *